US006855229B2

(12) United States Patent
McKay et al.

(10) Patent No.: US 6,855,229 B2
(45) Date of Patent: Feb. 15, 2005

(54) LOW VISCOSITY BILAYER DISRUPTED SOFTENING COMPOSITION FOR TISSUE PAPER

(75) Inventors: David D. McKay, Wilmington, OH (US); John Ernest Rice, Sharonville, OH (US); Kenneth Douglas Vinson, Cincinnati, OH (US); James Robert McFarland, Cincinnati, OH (US); Amy Jo Hamilton, Mason, OH (US); Errol Hoffman Wahl, Cincinnati, OH (US); Gayle Marie Frankenbach, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 0 days.

(21) Appl. No.: 10/758,790

(22) Filed: Jan. 16, 2004

(65) Prior Publication Data

US 2004/0144511 A1 Jul. 29, 2004

Related U.S. Application Data

(62) Division of application No. 09/586,270, filed on Nov. 30, 2000, now Pat. No. 6,797,117.

(51) Int. Cl.[7] ..... D21H 17/07; D21H 17/41; D21H 17/66; D21H 21/24

(52) U.S. Cl. ..... 162/179; 162/158; 162/164.6; 162/168.1; 162/168.2; 162/181.2; 162/183; 162/185; 162/109; 162/204; 162/207

(58) Field of Search ..... 162/109–117, 158, 162/164.1, 164.6, 164.7, 168.1, 168.2, 166, 167, 179, 181.1, 181.2, 182–185, 204–207; 510/516, 522, 524, 525, 527; 516/53, 59, 914; 106/218, 219, 137, 200.1; 250/8.61, 8.63

(56) References Cited

U.S. PATENT DOCUMENTS

| | | | |
|---|---|---|---|
| 3,301,746 | A | 1/1967 | Sanford et al. |
| 3,473,576 | A | 10/1969 | Amneus |
| 3,573,164 | A | 3/1971 | Friedberg et al. |
| 3,700,623 | A | 10/1972 | Keim |
| 3,772,076 | A | 11/1973 | Keim |
| 3,812,000 | A | 5/1974 | Salvucci, Jr. et al. |
| 3,821,068 | A | 6/1974 | Shaw et al. |

(List continued on next page.)

FOREIGN PATENT DOCUMENTS

| | | |
|---|---|---|
| EP | 0 617 164 A1 | 9/1994 |
| EP | 0 688 901 A2 | 12/1995 |
| EP | 0 898 045 A1 | 2/1999 |

*Primary Examiner*—Steven P. Griffin
*Assistant Examiner*—Eric Hug
(74) *Attorney, Agent, or Firm*—Stephen T. Murphy; David M. Weirich; Ken K. Patel

(57) ABSTRACT

Disclosed is a composition for softening a wet laid cellulosic structure. A particularly preferred structure is an absorbent tissue. Further disclosed are tissue structures softened using the composition. The composition includes an effective amount of a softening active ingredient; a vehicle in which the softening active ingredient is dispersed; an electrolyte dissolved in the vehicle; and a bilayer disrupter. The electrolyte and the bilayer disrupter cooperate to cause the viscosity of the composition to be less than the viscosity of a dispersion of the softening active ingredient in the vehicle alone. Preferably, the softening active ingredient is a quaternary ammonium compound with the formula:

$$(R_1)_{4-m}—N^+—[(CH_2)_n—Y—R_3]_mX^-$$

the vehicle is water, the electrolyte is calcium chloride, and the bilayer disrupter is a nonionic surfactant. Also disclosed is a method of using the compound by adding it at a use concentration to the wet end of a papermaking process.

20 Claims, 2 Drawing Sheets

U.S. PATENT DOCUMENTS 3,974,025 A 8/1976 Ayers
4,011,389 A 3/1977 Langdon et al.
4,191,609 A 3/1980 Trokhan
4,208,459 A 6/1980 Becker et al.
4,239,065 A 12/1980 Trokhan
4,300,981 A 11/1981 Carstens
4,476,323 A * 10/1984 Hellsten et al. ..... 564/294
4,497,716 A * 2/1985 Tai ..... 510/522
4,528,239 A 7/1985 Trokhan
4,637,859 A 1/1987 Trokhan
4,793,943 A * 12/1988 Haslop et al. ..... 510/397
4,874,465 A 10/1989 Cochrane et al.
4,981,557 A 1/1991 Bjorkquist
5,059,282 A 10/1991 Ampulski et al.
5,215,626 A 6/1993 Ampulski et al.
5,221,435 A 6/1993 Smith
5,228,954 A 7/1993 Vinson et al.
5,246,545 A 9/1993 Ampulski et al.
5,264,082 A 11/1993 Phan et al.
5,296,024 A * 3/1994 Hutcheson ..... 106/243
5,308,513 A * 5/1994 Harmalker et al. ..... 510/522
5,405,499 A 4/1995 Vinson
5,405,501 A 4/1995 Phan et al.
5,415,737 A 5/1995 Phan et al.
5,447,644 A * 9/1995 Guenin et al. ..... 510/516
5,474,689 A 12/1995 Laughlin et al.
5,487,813 A 1/1996 Vinson et al.
5,498,350 A * 3/1996 Sakata et al. ..... 510/526
5,510,000 A 4/1996 Phan et al.
5,525,345 A 6/1996 Warner et al.
5,538,595 A 7/1996 Trokhan et al.
5,543,067 A * 8/1996 Phan et al. ..... 106/287.25
5,562,649 A * 10/1996 Chauvette et al. ..... 604/375
5,573,637 A 11/1996 Ampulski et al.
5,611,890 A 3/1997 Vinson et al.
H1672 H 8/1997 Hermans et al.
5,656,132 A 8/1997 Farrington et al.
5,672,248 A 9/1997 Wendt et al.
5,747,443 A * 5/1998 Wahl et al. ..... 510/515
5,753,079 A * 5/1998 Jenny et al. ..... 162/158
5,814,188 A 9/1998 Vinson et al.
5,841,188 A 11/1998 Murasawa
6,126,784 A * 10/2000 Ficke et al. ..... 162/184
6,162,329 A 12/2000 Vinson et al.
6,228,223 B1 * 5/2001 Thebrin et al. ..... 162/163

* cited by examiner

LOW VISCOSITY BILAYER DISRUPTED SOFTENING COMPOSITION FOR TISSUE PAPER

This is a divisional application of U.S. patent application Ser. No. 09/586,270, now U.S. Pat. No. 6,797,117 filed in the names of McKay, et al. on Nov. 30, 2000.

TECHNICAL FIELD

This invention relates, in general, to softening cellulosic structures with cationic bond inhibiting compounds; and more specifically, to a composition having rheological properties which facilitate its use for enhancing the softness thereof. Most particularly, the invention relates to softening tissue paper webs and methods of producing such softened webs.

BACKGROUND OF THE INVENTION

Sanitary paper tissue products are widely used. Such items are commercially offered in formats tailored for a variety of uses such as facial tissues, toilet tissues and absorbent towels.

All of these sanitary products share a common need, specifically to be soft to the touch. Softness is a complex tactile impression evoked by a product when it is stroked against the skin. The purpose of being soft is so that these products can be used to cleanse the skin without being irritating. Effectively cleansing the skin is a persistent personal hygiene problem for many people. Objectionable discharges of urine, menses, and fecal matter from the perineal area or otorhinolaryngogical mucus discharges do not always occur at a time convenient for one to perform a thorough cleansing, as with soap and copious amounts of water for example. As a substitute for thorough cleansing, a wide variety of tissue and toweling products are offered to aid in the task of removing from the skin and retaining such discharges for disposal in a sanitary fashion. Not surprisingly, the use of these products does not approach the level of cleanliness that can be achieved by the more thorough cleansing methods, and producers of tissue and toweling products are constantly striving to make their products compete more favorably with thorough cleansing methods.

Shortcomings in tissue products for example cause many to stop cleaning before the skin is completely cleansed. Such behavior is prompted by the harshness of the tissue, as continued rubbing with a harsh implement can abrade the sensitive skin and cause severe pain. The alternative, leaving the skin partially cleansed, is chosen even though this often causes malodors to emanate and can cause staining of undergarments, and over time can cause skin irritations as well.

Disorders of the anus, for example hemorrhoids, render the perianal area extremely sensitive and cause those who suffer such disorders to be particularly frustrated by the need to clean their anus without prompting irritation.

Another notable case which prompts frustration is the repeated nose blowing necessary when one has a cold. Repeated cycles of blowing and wiping can culminate in a sore nose even when the softest tissues available today are employed.

Accordingly, making soft tissue and toweling products which promote comfortable cleaning without performance impairing sacrifices has long been the goal of the engineers and scientists who are devoted to research into improving tissue paper. There have been numerous attempts to reduce the abrasive effect, i.e., improve the softness of tissue products.

One area that has been exploited in this regard has been to select and modify cellulose fiber morphologies and engineer paper structures to take optimum advantages of the various available morphologies. Applicable art in this area includes: Vinson et. al. in U.S. Pat. No. 5,228,954, issued Jul. 20, 1993, Vinson in U.S. Pat. No. 5,405,499, issued Apr. 11, 1995, Cochrane et al. in U.S. Pat. No. 4,874,465 issued Oct. 17, 1989, and Hermans, et. al. in U.S. Statutory Invention Registration H1672, published on Aug. 5, 1997, all of which disclose methods for selecting or upgrading fiber sources to tissue and toweling of superior properties. Applicable art is further illustrated by Carstens in U.S. Pat. No. 4,300,981, issued Nov. 17, 1981, which discusses how fibers can be incorporated to be compliant to paper structures so that they have maximum softness potential. While such techniques as illustrated by these prior art examples are recognized broadly, they can only offer some limited potential to make tissues truly effective comfortable cleaning implements.

Another area which has received a considerable amount of attention is the addition of chemical softening agents (also referred to herein as "chemical softeners") to tissue and toweling products.

As used herein, the term "chemical softening agent" refers to any chemical ingredient which improves the tactile sensation perceived by the consumer who holds a particular paper product and rubs it across the skin. Although somewhat desirable for towel products, softness is a particularly important property for facial and toilet tissues. Such tactilely perceivable softness can be characterized by, but is not limited to, friction, flexibility, and smoothness, as well as subjective descriptors, such as a feeling like lubricious, velvet, silk or flannel. Suitable materials include those which impart a lubricious feel to tissue. This includes, for exemplary purposes only, basic waxes such as paraffin and beeswax and oils such as mineral oil and silicone oil as well as petrolatum and more complex lubricants and emollients such as quaternary ammonium compounds with long alkyl chains, functional silicones, fatty acids, fatty alcohols and fatty esters.

The field of work in the prior art pertaining to chemical softeners has taken two paths. The first path is characterized by the addition of softeners to the tissue paper web during its formation either by adding an attractive ingredient to the vats of pulp which will ultimately be formed into a tissue paper web, to the pulp slurry as it approaches a paper making machine, or to the wet web as it resides on a Fourdrinier cloth or dryer cloth on a paper making machine.

The second path is categorized by the addition of chemical softeners to tissue paper web after the web is dried. Applicable processes can be incorporated into the paper making operation as, for example, by spraying onto the dry web before it is wound into a roll of paper.

Exemplary art related to the former path categorized by adding chemical softeners to the tissue paper prior to its assembly into a web ("wet end" addition) includes U S. Pat. No. 5,264,082, issued to Phan and Trokhan on Nov. 23, 1993 and in U.S. Pat. No. 5,543,067, issued to Phan on Aug. 6, 1996, the disclosure of each being incorporated herein by reference. Such methods have found broad use in the industry. However, such prior art compositions are either solids or viscous liquids at room temperature. As a result, such prior art chemical softening composition must be heated before dilution to a use concentration for addition to the papermaking furnish. Such heating adds complexity to the papermaking process and poses an additional capital requirement for the necessary equipment.

Further exemplary art related to the addition of chemical softeners to the tissue paper web during its formation includes U.S. Pat. No. 5,059,282, issued to Ampulski, et. al. on Oct. 22, 1991 incorporated herein by reference. The Ampulski patent discloses a process for adding a polysiloxane compound to a wet tissue web (preferably at a fiber consistency between about 20% and about 35%). Such a method represents an advance in some respects over the addition of chemicals into the furnish for the papermaking machine. For example, such means target the application to one of the web surfaces as opposed to distributing the additive onto all of the fibers of the furnish. However, when such softening compositions are used there may be a loss of control of the sheet as it is creped from the Yankee dryer. A widely believed theory is that the additives interfere with the coating on the Yankee dryer so that the bond between the wet web and the dryer is weakened.

Considerable art has also been directed toward the application of chemical softeners to already-dried paper webs either at the so-called dry end of the papermaking machine or in a separate converting operation subsequent to the papermaking step. Exemplary art from this field includes U.S. Pat. No. 5,215,626, issued to Ampulski, et. al. on Jun. 1, 1993; U.S. Pat. No. 5,246,545, issued to Ampulski, et. al. on Sep. 21, 1993; U.S. Pat. No. 5,525,345, issued to Warner, et. al. on Jun. 11, 1996, and U.S. patent application Ser. No. 09/053,319 filed in the name of Vinson, et al. on Apr. 1, 1998 all incorporated herein by reference. The '626 Patent discloses a method for preparing soft tissue paper by applying a polysiloxane to a dry web. The '545 Patent discloses a similar method utilizing a heated transfer surface. The '345 Patent discloses methods of application including roll coating and extrusion for applying particular compositions to the surface of a dry tissue web. Finally, the Vinson, et al. application discloses compositions that are particularly suitable for surface application onto a tissue web.

While each of these references represent advances over the prior art, there is a continuing need for soft tissue paper products having good strength properties. There is also a need for improved softening compositions that can be applied to such tissue products to provide the requisite softness without adding additional complexity and capital expense to the manufacture of such products.

Such improved products, compositions, and methods are provided by the present invention as is shown in the following disclosure.

SUMMARY OF THE INVENTION

The present invention describes softening compositions that, when added to the wet end of a wet laid process for producing cellulosic structures, reduce the fiber to fiber bonding thereof, providing a structure with improved softness while providing acceptable strength and absorbency. The softening composition comprises:

- an effective amount of a softening active ingredient;
- a vehicle in which the softening active ingredient is dispersed;
- an electrolyte dissolved in the vehicle, the electrolyte causing the viscosity of the composition to be less than the viscosity of a dispersion of the softening composition in the vehicle alone; and
- a bilayer disrupter to further reduce the viscosity of the softening composition.

The term "cellulosic structure" as used herein is defined as a wet laid fabric, web, or sheet comprised of fibers containing cellulose. In its broadest sense, such structures possess a basis weight ranging from 10 g/m$^2$ to about 1 kg/m$^2$ and possess densities ranging from about 0.1 g/cc to as high as about 1 g/cc. The cellulosic structures of the present invention preferably derive at least a portion of their strength from the natural fiber to fiber bonds which form when a web of short cellulosic fibers is drained and dried from a aqueous slurry. Consequently, so called wet laid papermaking is the most common process employing the present invention.

The softening compositions of the present invention have desirable low viscosity at room temperature allowing dilution as a part of the papermaking process without the complexity and added cost of a heating step.

The term "vehicle" as used herein means a fluid that completely dissolves a chemical papermaking additive, or a fluid that is used to emulsify a chemical papermaking additive, or a fluid that is used to suspend a chemical papermaking additive. The vehicle may also serve as a carrier that contains a chemical additive or aids in the delivery of a chemical papermaking additive. All references are meant to be interchangeable and not limiting. The dispersion is the fluid containing the chemical papermaking additive. The term "dispersion" as used herein includes true solutions, suspensions, and emulsions. For purposes for this invention, all terms are interchangeable and not limiting.

The amount of the softening composition added to the cellulosic structure is preferably about 0.01% to about 10%, more preferably between about 0.03% and about 1% based on the total weight of the softening composition compared to the total weight of the resulting cellulosic structure.

The cellulosic structure is preferably a tissue paper, most preferably a tissue paper having a basis weight of from about 10 to about 100 g/m$^2$ and a fiber density of less than about 0.6 g/cc.

All percentages, ratios and proportions herein are by weight, unless otherwise specified.

BRIEF DESCRIPTION OF THE FIGURES

While the specification concludes with claims particularly pointing out and distinctly claiming the present invention, it is believed that the present invention will be better understood from the following description in conjunction with the appended example and with the following drawing, in which like reference numbers identify identical elements and wherein:

Figure 1:
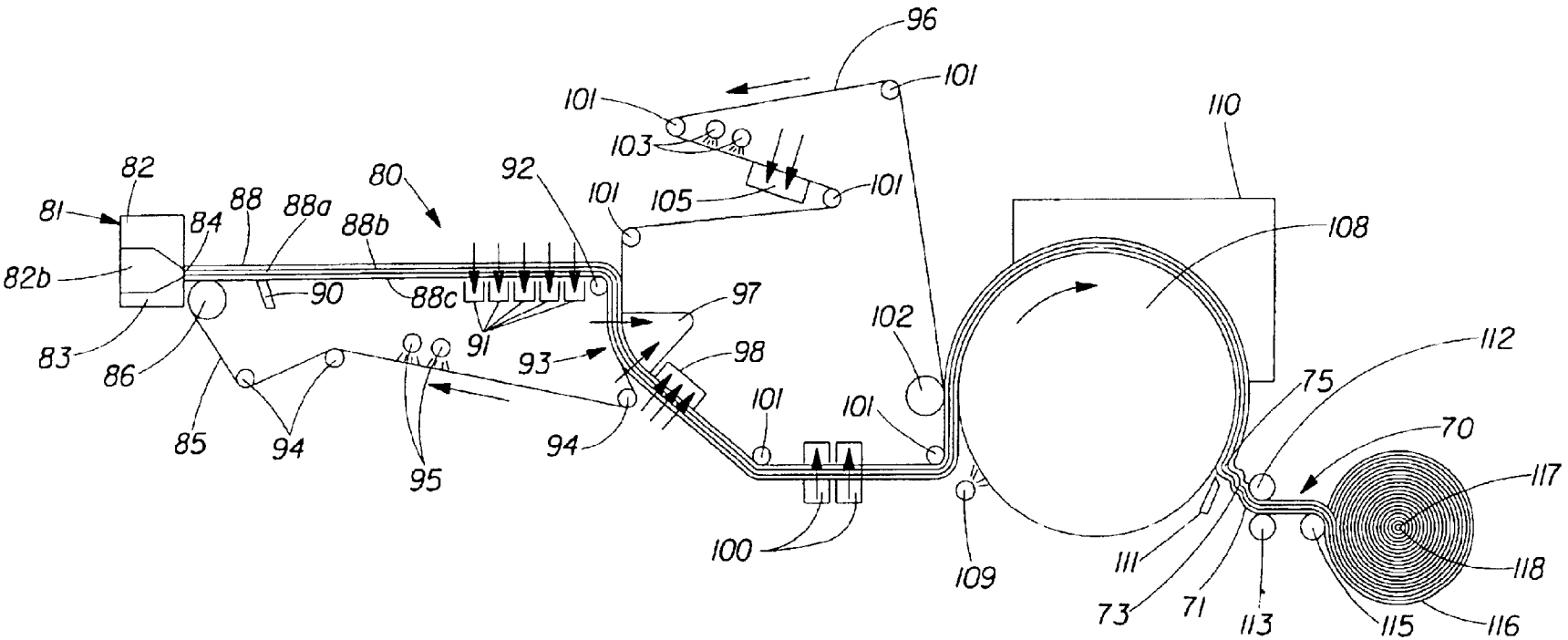
FIG. 1 is a schematic representation illustrating a creped papermaking process of the present invention for producing a strong, soft tissue paper comprising papermaking fibers using the softening composition of the present invention.

The present invention is described in more detail below.

DETAILED DESCRIPTION OF THE INVENTION

Briefly, the present invention provides a composition useful for softening cellulosic structures. Preferably, it is added to the wet end of a process for making the cellulosic structure. Most preferably, the cellulosic structure is a tissue paper. The resulting tissue paper comprising the composition of the present invention has enhanced tactilely perceivable softness. The softening composition, a method for producing the combination, and a method of adding it to wet end of a paper-making process are described.

The composition of the present invention is a dispersion of a softening active ingredient in a vehicle. Importantly, the composition also comprises a bilayer disrupter which allows the composition to have both a particularly high level of ingredients effective in softening tissue paper webs and, at the same time, a low viscosity at room temperature. Such compositions are particularly desirable for addition to the wet end of a papermaking process so as to provide paper made using such a process with desirable softness. Such compositions are especially desirable for use in processes used in the production of tissue paper products used for personal cleaning.

Tissue Paper

The present invention is applicable to tissue paper in general, including but not limited to: conventionally felt-pressed tissue paper; pattern densified tissue paper such as exemplified by Sanford-Sisson and its progeny; and high-bulk, uncompacted tissue paper such as exemplified by Salvucci. The tissue paper may be of a homogenous or multilayered construction; and tissue paper products made therefrom may be of a single-ply or multi-ply construction. The tissue paper preferably has a basis weight of between about 10 g/m$^2$ and about 100 g/m$^2$, and density of about 0.60 g/cc or less. Preferably, the basis weight will be between about 10 g/m$^2$ and about 80 g/m$^2$, and the density will be about 0.30 g/cc or less. Most preferably, the density will be between about 0.04 g/cc and about 0.20 g/cc.

Conventionally pressed tissue paper and methods for making such paper are known in the art. Such paper is typically made by depositing a papermaking furnish on a foraminous forming wire. This forming wire is often referred to in the art as a Fourdrinier wire. Once the furnish is deposited on the forming wire, it is referred to as a web. Overall, water is removed from the web by vacuum, mechanical pressing and thermal means. The web is dewatered by pressing the web and by drying at elevated temperature. The particular techniques and typical equipment for making webs according to the process just described are well known to those skilled in the art. In a typical process, a low consistency pulp furnish is provided in a pressurized headbox. The headbox has an opening for delivering a thin deposit of pulp furnish onto the Fourdrinier wire to form a wet web. The web is then typically dewatered to a fiber consistency of between about 7% and about 45% (total web weight basis) by vacuum dewatering and further dried by pressing operations wherein the web is subjected to pressure developed by opposing mechanical members, for example, cylindrical rolls. The dewatered web is then further pressed and dried by a stream drum apparatus known in the art as a Yankee dryer. Pressure can be developed at the Yankee dryer by mechanical means such as an opposing cylindrical drum pressing against the web. Multiple Yankee dryer drums may be employed, whereby additional pressing is optionally incurred between the drums. The tissue paper structures which are formed are referred to hereinafter as conventional, pressed, tissue paper structures. Such sheets are considered to be compacted, since the web is subjected to substantial overall mechanical compression forces while the fibers are moist and are then dried while in a compressed state. The resulting structure is strong and generally of singular density, but very low in bulk, absorbency and in softness.

Pattern densified tissue paper is characterized by having a relatively high-bulk field of relatively low fiber density and an array of densified zones of relatively high fiber density. The high-bulk field is alternatively characterized as a field of pillow regions. The densified zones are alternatively referred to as knuckle regions. The densified zones may be discretely spaced within the high-bulk field or may be interconnected, either fully or partially, within the high-bulk field. Preferred processes for making pattern densified tissue webs are disclosed in U.S. Pat. No. 3,301,746, issued to Sanford and Sisson on Jan. 31, 1967, U.S. Pat. No. 3,974,025, issued to Ayers on Aug. 10, 1976; and U.S. Pat. Nos. 4,191,609 and 4,637,859, issued to Trokhan on Mar. 4, 1980 and on Jan. 20, 1987 respectively; the disclosure of each of which is incorporated herein by reference.

In general, pattern densified webs are preferably prepared by depositing a papermaking furnish on a foraminous forming wire such as a Fourdrinier wire to form a wet web and then juxtaposing the web against an array of supports as it is transferred from the forming wire to a structure comprising such supports for further drying. The web is pressed against the array of supports, thereby resulting in densified zones in the web at the locations geographically corresponding to the points of contact between the array of supports and the wet web. The remainder of the web not compressed during this operation is referred to as the high-bulk field. This high-bulk field can be further dedensified by application of fluid pressure, such as with a vacuum type device or a blow-through dryer, or by mechanically pressing the web against the array of supports. The web is dewatered, and optionally predried, in such a manner so as to substantially avoid compression of the high-bulk field. This is preferably accomplished by fluid pressure, such as with a vacuum type device or blow-through dryer, or alternately by mechanically pressing the web against an array of supports wherein the high-bulk field is not compressed. The operations of dewatering, optional predrying and formation of the densified zones may be integrated or partially integrated to reduce the total number of processing steps performed. Subsequent to formation of the densified zones, dewatering, and optional predrying, the web is dried to completion, preferably still avoiding mechanical pressing. Preferably, from about 8% to about 65% of the tissue paper surface comprises densified knuckles, the knuckles preferably having a relative density of at least 125% of the density of the high-bulk field.

The structure comprising an array of supports is preferably an imprinting carrier fabric having a patterned displacement of knuckles which operate as the array of supports which facilitate the formation of the densified zones upon application of pressure. The pattern of knuckles constitutes the array of supports previously referred to. Imprinting carrier fabrics are disclosed in U.S. Pat. No. 3,301,746, issued to Sanford and Sisson on Jan. 31, 1967, U.S. Pat. No. 3,821,068, issued to Salvucci, Jr. et al. on May 21, 1974, U.S. Pat. No. 3,974,025, issued to Ayers on Aug. 10, 1976, U.S. Pat. No. 3,573,164, issued to Friedberg, et al. on Mar. 30, 1971, U.S. Pat. No. 3,473,576, issued to Amneus on Oct. 21, 1969, U.S. Pat. No. 4,239,065, issued to Trokhan on Dec. 16, 1980, and U.S. Pat. No. 4,528,239, issued to Trokhan on Jul. 9, 1985, the disclosure of each of which is incorporated herein by reference.

Preferably, the furnish is first formed into a wet web on a foraminous forming carrier, such as a Fourdrinier wire. The web is dewatered and transferred to an imprinting fabric. The furnish may alternately be initially deposited on a foraminous supporting carrier which also operates as an imprinting fabric. Once formed, the wet web is dewatered and, preferably, thermally predried to a selected fiber consistency of between about 40% and about 80%. Dewatering is preferably performed with suction boxes or other vacuum devices, with blow-through dryers, or combinations thereof. The knuckle imprint of the imprinting fabric is impressed in the web as discussed above, prior to drying the web to completion. One method for accomplishing this is through application of mechanical pressure. This can be done, for example, by pressing a nip roll which supports the imprinting fabric against the face of a drying drum, such as a Yankee dryer, wherein the web is disposed between the nip roll and drying drum. Also, preferably, the web is molded against the imprinting fabric prior to completion of drying by application of fluid pressure with a vacuum device such as a suction box, or with a blow-through dryer. Fluid pressure may be applied to induce impression of densified zones during initial dewatering, in a separate, subsequent process stage, or a combination thereof.

Uncompacted, non pattern-densified tissue paper structures are described in U.S. Pat. No. 3,812,000 issued to Joseph L. Salvucci, Jr. and Peter N. Yiannos on May 21, 1974, and U.S. Pat. No. 4,208,459, issued to Henry E. Becker, Albert L. McConnell, and Richard Schutte on Jun. 17, 1980, both of which are incorporated herein by reference. In general, uncompacted, non pattern-densified tissue paper structures are prepared by depositing a papermaking furnish on a foraminous forming wire such as a Fourdrinier wire to form a wet web, draining the web and removing additional water without mechanical compression until the web has a fiber consistency of at least 80%, and creping the web. Water is removed from the web by vacuum dewatering and thermal drying. The resulting structure is a soft but weak high-bulk sheet of relatively uncompacted fibers. Bonding material is preferably applied to portions of the web prior to creping.

The softening composition of the present invention can also be useful for softening uncreped tissue paper. Uncreped tissue paper, a term as used herein, refers to tissue paper which is non-compressively dried, most preferably by through air drying. Resultant through air dried webs are pattern densified such that zones of relatively high density are dispersed within a high bulk field, including pattern densified tissue wherein zones of relatively high density are continuous and the high bulk field is discrete.

To produce uncreped tissue paper webs, an embryonic web is transferred from the foraminous forming carrier upon which it is laid, to a slower moving, high fiber support transfer fabric carrier. The web is then transferred to a drying fabric upon which it is dried to a final dryness. Such webs can offer some advantages in surface smoothness compared to creped paper webs.

The techniques to produce uncreped tissue in this manner are taught in the prior art. For example, Wendt, et. al. in U.S. Pat. No. 5,672,248, issued on Sep. 30, 1997 and incorporated herein by reference, teach a method of making soft tissue products without creping. In another case, Hyland, et. al. in European Patent Application 0 617 164 A1, published Sep. 28, 1994 and incorporated herein by reference, teach a method of making smooth uncreped through air dried sheets. Finally, Farrington, et. al. in U.S. Pat. No. 5,656,132 published Aug. 12, 1997, the disclosure of which is incorporated herein by reference, describes the use of a machine to make soft through air dried tissues without the use of a Yankee.

Furnish

Papermaking Fibers

The papermaking fibers utilized for the present invention will normally include fibers derived from wood pulp. Other cellulosic fibrous pulp fibers, such as cotton linters, bagasse, etc., can be utilized and are intended to be within the scope of this invention. Synthetic fibers, such as rayon, polyethylene and polypropylene fibers, may also be utilized in combination with natural cellulosic fibers. One exemplary polyethylene fiber which may be utilized is Pulpex®, available from Hercules, Inc. (Wilmington, Del.).

Applicable wood pulps include chemical pulps, such as Kraft, sulfite, and sulfate pulps, as well as mechanical pulps including, for example, groundwood, thermomechanical pulp and chemically modified thermomechanical pulp. Chemical pulps, however, are preferred since they impart a superior tactile sense of softness to tissue sheets made therefrom. Pulps derived from both deciduous trees (hereinafter, also referred to as "hardwood") and coniferous trees (hereinafter, also referred to as "softwood") may be utilized. Also applicable to the present invention are fibers derived from recycled paper, which may contain any or all of the above categories as well as other non-fibrous materials such as fillers and adhesives used to facilitate the original papermaking.

Particularly preferred cellulosic pulps include long fibers such as Northern softwood Kraft (NSK); short fibers, such as Eucalyptus; and secondary fibers, such as pre and post consumer white ledger, coated book stock, and office waste. Such fibers may be used in any desired combination, with or without layering.

Softening Composition

In general, the softening composition of the present invention comprises a dispersion of a softening active ingredient in a vehicle. When dispersed in a furnish used to produce tissue paper or other cellulosic structures as described herein, such compositions are effective in softening the structures. Preferably, the softening composition of the present invention has properties (e.g., ingredients, rheology, pH, etc.) permitting easy application thereof on a commercial scale.

It is well known to those skilled in the art that quaternary ammonium compounds which comprise the preferred active ingredient of the softening composition of the present invention are not usually readily dispersible in water. The preferred quaternary compounds are solids at room temperature and when added to water are difficult to disperse into a uniform dispersion even with the application of mechanical action. It is also well known that the desired form for softening composition is a cold-water dispersible liquid. Previous attempts to solve this conflict have not been entirely satisfactory.

One method has been to use highly active organic solvents capable of solubilizing the quaternary ammonium compound liquid at room temperature and making it dispersible in water. For example, a low molecular weight alcohol such as isopropanol can be used. Such methods are not desired because of the increased process safety and environmental burden (VOC) concerns raised by the volatility of such solvents. Solvents which are less active can be employed, but much larger quantities are required with resulting negative cost and environmental consequences as well.

Another method employed historically has been to render the quaternary ammonium compound more fluid, for example by introducing more carbon to carbon double bonds in the long alkyl chains of the preferred quaternary ammonium compounds. These materials are typically either more costly or burdened by side effects such as odor.

Quaternary ammonium compounds can also be made more fluid and more dispersible by increasing their hydrophilicity by, for example, ethoxylating the alkyl chains thereof This method decreases the effectiveness of the quaternary ammonium compound as a softening ingredient and involves additional processing cost as well.

The composition of the present invention is a highly concentrated form of a preferred softening active ingredient, a quaternary ammonium compound, that is still readily water dispersible. The following discusses each of the components of the softening composition of the present invention, the properties of the composition, methods of producing the composition, and methods of applying the composition.

Components

Softening Active Ingredients

Quaternary compounds having the formula:

$$(R_1)_{4-m}—N^+—[R_2]_mX^-$$

wherein:

m is 1 to 3;

each $R_1$ is a $C_1$–$C_6$ alkyl group, hydroxyalkyl group, hydrocarbyl or substituted hydrocarbyl group, alkoxylated group, benzyl group, or mixtures thereof;

each $R_2$ is a $C_{14}$–$C_{22}$ alkyl group, hydroxyalkyl group, hydrocarbyl or substituted hydrocarbyl group, alkoxylated group, benzyl group, or mixtures thereof; and $X^-$ is any softener-compatible anion are suitable for use in the present invention. Preferably, each $R_1$ is methyl and $X^-$ is chloride or methyl sulfate. Preferably, each $R_2$ is $C_{16}$–$C_{18}$ linear or branched alkyl or alkenyl, most preferably each $R_2$ is straight-chain $C_{18}$ alkyl or alkenyl. Optionally, the $R_2$ substituent can be derived from vegetable oil sources. Several types of the vegetable oils (e.g., olive, canola, safflower, sunflower, etc.) can used as sources of fatty acids to synthesize the quaternary ammonium compound. Branched chain actives (e.g. as can be derived from the equivalent branched chain fatty acid) are also effective and have the additional advantage of oxidation resistance. Suitable branched chain fatty acids that can serve as a starting point for such quaternary ammonium compounds include: 2-n-heptylundecanoic acid, 2-n-butyloctanoic acid, 5,7,9-trimethylnonanoic acid, 3,5,7,9-tetramethylnonanoic, alpha-heptyldecanoic acid, and isostearic acid, with isostearic acid being particularly preferred.

Such structures include the well-known dialkyldimethylammonium salts (e.g. ditallowdimethylammonium chloride, ditallowdimethylammonium methyl sulfate, di(hydrogenated tallow)dimethyl ammonium chloride, etc.), in which $R_1$ are methyl groups, $R_2$ are tallow groups of varying levels of saturation, and $X^-$ is chloride or methyl sulfate.

As discussed in Swern, Ed. in Bailey's Industrial Oil and Fat Products, Third Edition, John Wiley and Sons (New York 1964), tallow is a naturally occurring material having a variable composition. Table 6.13 in the above-identified reference edited by Swern indicates that, typically, 78% or more of the fatty acids of tallow contain 16 or 18 carbon atoms. Typically, half of the fatty acids present in tallow are unsaturated, primarily in the form of oleic acid. Synthetic as well as natural "tallows" fall within the scope of the present invention. It is also known that depending upon the product characteristic requirements, the saturation level of the ditallow can be tailored from non hydrogenated (soft) to touch hydrogenated (partially hydrogenated) or completely hydrogenated (hard). All of above-described saturation levels of are expressly meant to be included within the scope of the present invention.

Particularly preferred variants of these softening active ingredients are what are considered to be mono or diester variations of these quaternary ammonium compounds having the formula:

$$(R_1)_{4-m}—N^+—[(CH_2)_n—Y—R_3]_mX^-$$

wherein

Y is —O—(O)C—, or —C(O)—O—, or —NH—C(O)—, or —C(O)—NH—;

m is 1 to 3;

n is 0 to 4;

each $R_1$ is a $C_{1-6}$ alkyl group, hydroxyalkyl group, hydrocarbyl or substituted hydrocarbyl group, alkoxylated group, benzyl group, or mixtures thereof;

each $R_3$ is a $C_{13}$–$C_{21}$ linear or branched alkyl group, hydroxyalkyl group, hydrocarbyl or substituted hydrocarbyl group, alkoxylated group, benzyl group, or mixtures thereof; and $X^-$ is any softener-compatible anion.

Preferably, Y=—O—(O)C—, or —C(O)—O—; m=2; and n=2. Each $R_1$ substituent is preferably a $C_1$–$C_3$, alkyl group, with methyl being most preferred. Preferably, each $R_3$ is $C_{13}$ –$C_{17}$ alkyl and/or alkenyl, more preferably $R_3$ is straight chain $C_{15}$–$C_{17}$ alkyl and/or alkenyl, $C_{15}$–$C_{17}$ alkyl, most preferably each $R_3$ is straight-chain $C_{17}$ alkyl. Optionally, the $R_3$ substituent can be derived from vegetable oil sources. Several types of the vegetable oils (e.g., olive, canola, safflower, sunflower, etc.) can used as sources of fatty acids to synthesize the quaternary ammonium compound. Preferably, olive oils, canola oils, high oleic safflower, and/or high erucic rapeseed oils are used to synthesize the quaternary ammonium compound.

As mentioned above, $X^-$ can be any softener-compatible anion, for example, acetate, chloride, bromide, methylsulfate, formate, sulfate, nitrate and the like can also be used in the present invention. Preferably $X^-$ is chloride or methyl sulfate.

Specific examples of ester-functional quaternary ammonium compounds having the structures named above and suitable for use in the present invention include the well-known diester dialkyl dimethyl ammonium salts such as diester ditallow dimethyl ammonium chloride, monoester ditallow dimethyl ammonium chloride, diester ditallow dimethyl ammonium methyl sulfate, diester di(hydrogenated) tallow dimethyl ammonium methyl sulfate, diester di(hydrogenated)tallow dimethyl ammonium chloride, and mixtures thereof. Diester ditallow dimethyl ammonium chloride and diester di(hydrogenated)tallow dimethyl ammonium chloride are particularly preferred. The diester ditallow dimethyl ammonium chloride and diester di(hydrogenated)tallow dimethyl ammonium chloride is available commercially from Witco Chemical Company Inc. of Dublin, Ohio under the tradename ADOGEN SDMC.

As mentioned above, typically, half of the fatty acids present in tallow are unsaturated, primarily in the form of oleic acid. Synthetic as well as natural "tallows" fall within the scope of the present invention. It is also known that depending upon the product characteristic requirements, the degree of saturation for such tallows can be tailored from non hydrogenated (soft), to partially hydrogenated (touch), or completely hydrogenated (hard). All of above-described saturation levels of are expressly meant to be included within the scope of the present invention. At least a minimal level of hydrogenation is preferred in order to remove, in particular, the multiply unsaturated species (e.g. linolenic derivatives) which are known to be more susceptible to oxidation with resulting rancidity.

It will be understood that substituents $R_1$, $R_2$ and $R_3$ may optionally be substituted with various groups such as alkoxyl, hydroxyl, or can be branched. As mentioned above, preferably each $R_1$ is methyl or hydroxyethyl. Preferably, each $R_2$ is $C_{12}$–$C_{18}$ alkyl and/or alkenyl, most preferably each $R_2$ is straight-chain $C_{16}$–$C_{18}$ alkyl and/or alkenyl, most preferably each $R_2$ is straight-chain $C_{18}$ alkyl or alkenyl. Preferably $R_3$ is $C_{13}$–$C_{17}$ alkyl and/or alkenyl, most preferably $R_3$ is straight chain $C_{15}$–$C_{17}$ alkyl and/or alkenyl. Preferably, $X^-$ is chloride or methyl sulfate. Furthermore the ester-functional quaternary ammonium compounds can optionally contain up to about 10% of the mono(long chain alkyl) derivatives, e.g.:

$$(R_1)_2—N^+—((CH_2)_2OH)((CH_2)_2OC(O)R_3)X^-$$

as minor ingredients. These minor ingredients can act as emulsifiers and are useful in the present invention.

Other types of suitable quaternary ammonium compounds for use in the present invention are described in U.S. Pat. No. 5,543,067, issued to Phan et al. on Aug. 6, 1996; U.S. Pat. No. 5,538,595, issued to Trokhan et al., on Jul. 23, 1996; U.S. Pat. No. 5,510,000, issued to Phan et al. on Apr. 23, 1996; U.S. Pat. No. 5,415,737, issued to Phan et al., on May 16, 1995; and European Patent Application No. 0 688 901 A2, assigned to Kimberly-Clark Corporation, published Dec. 12, 1995; the disclosure of each of which is incorporated herein by reference.

Di-quat variations of the ester-functional quaternary ammonium compounds can also be used, and are meant to fall within the scope of the present invention. These compounds have the formula:

$$R_1—\overset{\overset{\displaystyle O}{\|}}{C}—O—(CH_2)_2—\overset{\overset{\displaystyle (R_1)_2}{|}}{N^+}—(CH_2)_n—\overset{\overset{\displaystyle (R_1)_2}{|}}{N^+}(CH_2)_2—O—\overset{\overset{\displaystyle O}{\|}}{C}—R_3 \quad 2X^-$$

$$R_1—C—O—(CH_2)_2—N^+—(CH_2)_n—N^+(CH_2)_2—O—C—R_3 \; 2X^-$$

In the structure named above each $R_1$ is a $C_1$–$C_6$alkyl or hydroxyalkyl group, $R_3$ is $C_{11}$–$C_{21}$ hydrocarbyl group, n is 2 to 4 and $X^-$ is a suitable anion, such as an halide (e.g., chloride or bromide) or methyl sulfate. Preferably, each $R_3$ is $C_{13}$–$C_{17}$ alkyl and/or alkenyl, most preferably each $R_3$ is straight-chain $C_{15}$–$C_{17}$ alkyl and/or alkenyl, and $R_1$ is a methyl.

Parenthetically, while not wishing to be bound by theory, it is believed that the ester moiety(ies) of the aforementioned quaternary compounds provides a measure of biodegradability to such compounds. Importantly, the ester-functional quaternary ammonium compounds used herein biodegrade more rapidly than do conventional dialkyl dimethyl ammonium chemical softeners.

The use of quaternary ammonium ingredients as described herein above is most effectively accomplished if the quaternary ammonium ingredient is accompanied by an appropriate plasticizer. The term plasticizer as used herein refers to an ingredient capable of reducing the melting point and viscosity at a given temperature of a quaternary ammonium ingredient. The plasticizer can be added during the quaternizing step in the manufacture of the quaternary ammonium ingredient or it can be added subsequent to the quaternization but prior to the application as a softening active ingredient. The plasticizer is characterized by being substantially inert during the chemical synthesis of the quaternary ammonium compound where it can act as a viscosity reducer to aid in the synthesis. Preferred plasticizers are non-volatile polyhydroxy compounds. Preferred polyhydroxy compounds include glycerol and polyethylene glycols having a molecular weight of from about 200 to about 2000, with polyethylene glycol having a molecular weight of from about 200 to about 600 being particularly preferred. When such plasticizers are added during manufacture of the quaternary ammonium ingredient, they comprise between about 5% and about 75% percent of the product of such manufacture. Particularly preferred mixtures comprise between about 15% and about 50% plasticizer.

Vehicle

As used herein a "vehicle" is used to dilute the active ingredients of the compositions described herein forming the dispersion of the present invention. A vehicle may dissolve such components (true solution or micellar solution) or such components may be distributed throughout the vehicle (dispersion, emulsion, or sponge phase). The vehicle of a suspension or emulsion is typically the continuous phase thereof. That is, other components of the dispersion or emulsion are dispersed on a molecular level or as discrete particles or molecular aggregates throughout the vehicle.

For purposes of the present invention, one purpose that the vehicle serves is to dilute the concentration of softening active ingredients so that such ingredients may be efficiently and economically applied. Such diluted compositions are more readily diluted to a use concentration without the need for complex processing equipment.

Vehicles and softening compositions comprising such vehicles have also been discovered that are particularly useful for facilitating the incorporation of softening active ingredients into webs of tissue on a commercial scale.

While softening ingredients can be dissolved in a vehicle forming a solution therein, materials that are useful as solvents for suitable softening active ingredients are not commercially desirable for safety and environmental reasons. Therefore, to be suitable for use in the vehicle for purposes of the present invention, a material should be compatible with the softening active ingredients described herein and with the tissue substrate with which the softening compositions of the present invention will be used. Further a suitable material should not contain any ingredients that create safety issues (either in the tissue manufacturing process or to users of tissue products using the softening compositions described herein) and not create an unacceptable risk to the environment. Suitable materials for the vehicle of the present invention include hydroxyl functional liquids most preferably water.

Electrolyte

While water is a particularly preferred material for use in the vehicle of the present invention, water alone is not preferred as a vehicle. Specifically, when softening active ingredients of the present invention are dispersed in water at a level suitable for application to a tissue web, the dispersion has an unacceptably high viscosity. While not being bound by theory, it is believed that combining water and the softening active ingredients of the present invention to form such dispersions creates a liquid crystalline phase having a high viscosity. Compositions having such a high viscosity are difficult to dilute for use in a process for producing tissue webs softening the web.

It has been discovered that the viscosity of dispersions of softening active ingredients in water can be substantially reduced, while maintaining a desirable high level of the softening active ingredient in the softening composition by the simple addition of a suitable electrolyte to the vehicle. Again, not being bound by theory, it is believed that the electrolyte shields the electrical charge around bilayers and vesicles, reducing interactions, and lowering resistance to movement resulting in a reduction in viscosity of the system. Additionally, again not being bound by theory, the electrolyte can create an osmotic pressure difference across vesicle walls which would tend to draw interior water through the vesicle wall reducing the size of the vesicles and providing more "free" water, again resulting in a decrease in viscosity.

Any electrolyte meeting the general criteria described above for materials suitable for use in the vehicle of the present invention and which is effective in reducing the viscosity of a dispersion of a softening active ingredient in water is suitable for use in the vehicle of the present invention. In particular, any of the known water-soluble electrolytes meeting the above criteria can be included in the vehicle of the softening composition of the present invention. When present, the electrolyte can be used in amounts up to about 25% by weight of the softening composition, but preferably no more than about 15% by weight of the softening composition. Preferably, the level of electrolyte is between about 0.1% and about 10% by weight of the softening composition based on the anhydrous weight of the electrolyte. Still more preferably, the electrolyte is used at a level of between about 0.3% and about 1.0% by weight of the softening composition. The minimum amount of the electrolyte will be that amount sufficient to provide the desired viscosity. The dispersions typically display a non-Newtonian rheology, and are shear thinning with a desired viscosity generally ranging from about 10 centipoise (cp) up to about 1000 cp, preferably in the range between about 10 and about 200 cp, as measured at 25° C. and at a shear rate of 100 $sec^{-1}$ using the method described in the TEST METHODS section below. Suitable electrolytes include the halide, nitrate, nitrite, and sulfate salts of alkali or alkaline earth metals, as well as the corresponding ammonium salts. Other useful electrolytes include the alkali and alkaline earth salts of simple organic acids such as sodium formate and sodium acetate, as well as the corresponding ammonium salts. Preferred electrolytes include the chloride salts of sodium, calcium, and magnesium. Calcium chloride is a particularly preferred electrolyte for the softening composition of the present invention. While not being bound by theory, it is believed that the divalent nature of the calcium ion makes it particularly effective in reducing the viscosity of the vesicular dispersions of the softening active ingredient. If desired, compatible blends of the various electrolytes are also suitable.

Bilayer Disrupter

A bilayer disrupter is an essential component of the invention. While, as has been shown above, the vehicle, particularly the electrolyte component dissolved therein, performs an essential function in preparing the cellulosic structures of the present invention, it is desirable also to maximize the concentration of softening active ingredient while maintaining an acceptable viscosity. As noted above, addition of electrolyte allows an increase in the concentration of softening active ingredient in the softening composition without unduly increasing viscosity. However, if too much electrolyte is used, phase separation can occur. It has been found that adding a bilayer disrupter to the softening composition allows more softening active ingredient to be incorporated therein while maintaining viscosity at an acceptable level. As used herein a "bilayer disrupter" is an organic material that, when mixed with a dispersion of a softening active ingredient in a vehicle, is compatible with at least one of the vehicle or the softening active ingredient and causes a reduction of the viscosity of the dispersion.

Not to be bound by theory, it is believed that bilayer disrupters function by penetrating the palliside layer of the liquid crystalline structure of the dispersion of the softening active ingredient in the vehicle and disrupting the order of the liquid crystalline structure. Such disruption is believed to reduce the interfacial tension at the hydrophobic-water interface, thus promoting flexibility with a resulting reduction in viscosity. As used herein, the term "pallisade layer", it is meant describe the area between hydrophilic groups and the first few carbon atoms in the hydrophobic layer (M. J Rosen, Surfactants and interfacial phenomena, Second Edition, pages 125 and 126).

In addition to providing the viscosity reduction benefits discussed above, materials suitable for use as a bilayer disrupter should be compatible with other components of the softening composition. For example, a suitable material should not react with other components of the softening composition so as to cause the softening composition to lose softening capability.

Bilayer disrupters useful in the compositions of the present invention are preferably surface active materials. Such materials comprise both hydrophobic and hydrophilic moieties. A preferred hydrophilic moiety is a polyalkoxylated group, preferably a polyethoxylated group. Such preferred materials are used at a level of between about 1% and about 15% of the level of the softening active ingredient. Preferably, the bilayer disrupter is present at a level of between about 2% and about 10% of the level of the softening active ingredient.

Particularly preferred bilayer disrupters are nonionic surfactants derived from saturated and/or unsaturated primary and/or secondary, amine, amide, amine-oxide fatty alcohol, fatty acid, alkyl phenol, and/or alkyl aryl carboxylic acid compounds, each preferably having from about 6 to about 22, more preferably from about 8 to about 18, carbon atoms in a hydrophobic chain, more preferably an alkyl or alkylene chain, wherein at least one active hydrogen of said compounds is ethoxylated with $\leqq 50$, preferably $\leqq 30$, more preferably from about 3 to about 15, and even more preferably from about 5 to about 12, ethylene oxide moieties to provide an HLB of from about 6 to about 20, preferably from about 8 to about 18, and more preferably from about 10 to about 15.

Suitable bilayer disrupters also include nonionic surfactants with bulky head groups selected from:

a. surfactants having the formula $$R^1—C(O)—Y'—[C(R^5)]_m—CH_2O(R_2O)_2H$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2—O)_z—H$; $—(CH_2)_xCH_3$; phenyl, or substituted aryl, wherein $0 \leqq x \leqq$ about 3 and z is from about 5 to about 30; each $R^2$ is selected from the following groups or combinations of the following groups: $—(CH_2)_n—$ and/or $—[CH(CH_3)CH_2]—$; and each $R^5$ is selected from the following groups: —OH; and $—O(R^2O)_z—H$; and m is from about 2 to about 4;

b. surfactants having the formulas:

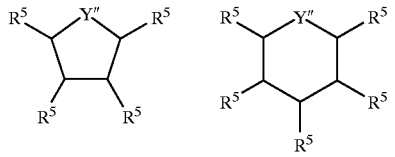

wherein Y"=N or O; and each $R^5$ is selected independently from the following: —H, —OH, —$(CH_2)xCH_3$, —$O(OR^2)_z$—H, —$OR^1$, —OC(O)$R^1$, and —CH($CH_2$—$(OR^2)_z$—H)—$CH_2$—$(OR^2)_z$—C(O) $R^1$, x and $R^1$ are as defined above and $5 \leqq z,z',$ and $z'' \leqq 20$, more preferably $5 \leqq z+z'+z'' \leqq 20$, and most preferably, the heterocyclic ring is a five member ring with Y"=O, one $R^5$ is —H, two $R^5$ are —O—$(R^2O)z$—H, and at least one $R^5$ is the following structure —CH($CH_2$—$(OR^2)_z$—H)—$CH_2$—$(OR^2)_z$—C(O) $R^1$ with $8 \leqq z+z'+z'' \leqq 20$ and $R^1$ is a hydrocarbon with from 8 to 20 carbon atoms and no aryl group;

c. polyhydroxy fatty acid amide surfactants of the formula:

$$R^2—C(O)—N(R^1)—Z$$

wherein: each $R^1$ is H, $C_1$–$C_4$ hydrocarbyl, $C_1$–$C_4$ alkoxyalkyl, or hydroxyalkyl; and $R^2$ is a $C_5$–$C_{31}$ hydrocarbyl moiety; and each Z is a polyhydroxyhydrocarbyl moiety having a linear hydrocarbyl chain with at least 3 hydroxyls directly connected to the chain, or an ethoxylated derivative thereof; and each R' is H or a cyclic mono- or polysaccharide, or alkoxylated derivative thereof; and Suitable phase stabilizers also include surfactant complexes formed by one surfactant ion being neutralized with surfactant ion of opposite charge or an electrolyte ion that is suitable for reducing dilution viscosity.

Examples of representative bilayer disrupters include:

(1)—Alkyl or Alkyl-aryl Alkoxylated Nonionic Surfactants

Suitable alkyl alkoxylated nonionic surfactants are generally derived from saturated or unsaturated primary, and secondary fatty alcohols, fatty acids, alkyl phenols, or alkyl aryl (e.g., benzoic) carboxylic acid, where the active hydrogen(s) is alkoxylated with ≦about 30 alkylene, preferably ethylene, oxide moieties (e.g. ethylene oxide and/or propylene oxide). These nonionic surfactants for use herein preferably have from about 6 to about 22 carbon atoms on the alkyl or alkenyl chain, and are in a straight chain configuration, preferably straight chain configurations having from about 8 to about 18 carbon atoms, with the alkylene oxide being present, preferably at the primary position, in average amounts of ≦about 30 moles of alkylene oxide per alkyl chain, more preferably from about 3 to about 15 moles of alkylene oxide, and most preferably from about 6 to about 12 moles of alkylene oxide. Preferred materials of this class also have pour points of less than about 70° F. (21° C.) and/or do not solidify in these softening compositions. Examples of alkyl alkoxylated surfactants with straight chains include Neodol® 91-8, 23-5, 25-9, 1-9, 25-12, 1-9, and 45-13 from Shell, Plurafac® B-26 and C-17 from BASF, and Brij® 76 and 35 from ICI Surfactants. Examples of alkyl-aryl alkoxylated surfactants include: Surfonic N-120 from Huntsman, Igepal® CO-620 and CO-710, from Rhone Poulenc, Triton® N-111 and N-150 from Union Carbide, Dowfax® 9N5 from Dow and Lutensol® AP9 and AP14, from BASF.

(2)—Alkyl or Alkyl-aryl Amine or Amine Oxide Nonionic Alkoxylated Surfactants

Suitable alkyl alkoxylated nonionic surfactants with amine functionality are generally derived from saturated or unsaturated, primary, and secondary fatty alcohols, fatty acids, fatty methyl esters, alkyl phenol, alkyl benzoates, and alkyl benzoic acids that are converted to amines, amine-oxides, and optionally substituted with a second alkyl or alkyl-aryl hydrocarbon with one or two alkylene oxide chains attached at the amine functionality each having ≦about 50 moles alkylene oxide moieties (e.g. ethylene oxide and/or propylene oxide) per mole of amine. The amine, amide or amine-oxide surfactants for use herein have from about 6 to about 22 carbon atoms, and are in either straight chain or branched chain configuration, preferably there is one hydrocarbon in a straight chain configuration having about 8 to about 18 carbon atoms with one or two alkylene oxide chains attached to the amine moiety, in average amounts of ≦50 about moles of alkylene oxide per amine moiety, more preferably from about 3 to about 15 moles of alkylene oxide, and most preferably a single alkylene oxide chain on the amine moiety containing from about 6 to about 12 moles of alkylene oxide per amine moiety. Preferred materials of this class also have pour points less than about 70° F. (21° C.) and/or do not solidify in these softening compositions. Examples of ethoxylated amine surfactants include Berol® 397 and 303 from Rhone Poulenc and Ethomeens® C/20, C25, T/25, S/20, S/25 and Ethodumeens® T/20 and T25 from Akzo.

Preferably, the compounds of the alkyl or alkyl-aryl alkoxylated surfactants and alkyl or alkyl-aryl amine, amide, and amine-oxide alkoxylated have the following general formula:

$$R^1{}_m—Y—[(R^2—O)_z—H]_p$$

wherein each $R^1$ is selected from the group consisting of saturated or unsaturated, primary, secondary or branched chain alkyl or alkyl-aryl hydrocarbons; said hydrocarbon chain preferably having a length of from about 6 to about 22, more preferably from about 8 to about 18 carbon atoms, and even more preferably from about 8 to about 15 carbon atoms, preferably, linear and with no aryl moiety; wherein each $R^2$ is selected from the following groups or combinations of the following groups: —$(CH_2)_n$— and/or —[CH($CH_3$)$CH_2$]—; wherein about $1<n \leqq$ about 3; Y is selected from the following groups: —O—; —$N(A)_q$—; —C(O)O—; —(O←)$N(A)_q$—; —B—$R^3$—O—; —B—$R^3$—N(A)q—; —B—$R^3$—C(O)O—; —B—$R^3$—N(→O)(A)—; and mixtures thereof; wherein A is selected from the following groups: H; $R^1$; —$(R^2—O)_z$—H; —$(CH_2)_xCH_3$; phenyl, or substituted aryl, wherein $0 \leqq x \leqq$ about 3 and B is selected from the following groups: —O—; —N(A)—; —C(O)O—; and mixtures thereof in which A is as defined above; and wherein each $R^3$ is selected from the following groups: $R^2$; phenyl; or substituted aryl. The terminal hydrogen in each alkoxy chain can be replaced by a short chain $C_{1-4}$ alkyl or acyl group to "cap" the alkoxy chain. z is from about 5 to about 30. p is the number of ethoxylate chains, typically one or two, preferably one and m is the number of hydrophobic chains, typically one or two, preferably one and q is a number that completes the structure, usually one.

Preferred structures are those in which m=1, p=1 or 2, and $5 \leqq z \leqq 30$, and q can be 1 or 0, but when p=2, q must be 0; more preferred are structures in which m=1, p=1 or 2, and $7 \leqq z \leqq 20$; and even more preferred are structures in which m=1, p=1 or 2, and $9 \leqq z \leqq 12$. The preferred y is 0.

(3)—Alkoxylated and Non-alkoxylated Nonionic Surfactants with Bulky Head Groups

Suitable alkoxylated and non-alkoxylated bilayer disrupters with bulky head groups are generally derived from saturated or unsaturated, primary and secondary fatty alcohols, fatty acids, alkyl phenol, and alkyl benzoic acids that are derivatized with a carbohydrate group or heterocyclic head group. This structure can then be optionally substituted with more alkyl or alkyl-aryl alkoxylated or non-alkoxylated hydrocarbons. The heterocyclic or carbohydrate is alkoxylated with one or more alkylene oxide chains (e.g. ethylene oxide and/or propylene oxide) each having ≦about 50, preferably ≦about 30, moles per mole of heterocyclic or carbohydrate. The hydrocarbon groups on the carbohydrate or heterocyclic surfactant for use herein have from about 6 to about 22 carbon atoms, and are in a straight chain configuration, preferably there is one hydrocarbon having from about 8 to about 18 carbon atoms with one or two alkylene oxide chains carbohydrate or heterocyclic moiety with each alkylene oxide chain present in average amounts of ≦about 50, preferably ≦about 30, moles of carbohydrate or heterocyclic moiety, more preferably from about 3 to about 15 moles of alkylene oxide per alkylene oxide chain, and most preferably between about 6 and about 12 moles of alkylene oxide total per surfactant molecule including alkylene oxide on both the hydrocarbon chain and on the heterocyclic or carbohydrate moiety. Examples of bilayer disrupters in this class are Tween® 40, 60, and 80 available from ICI Surfactants.

Preferably the compounds of the alkoxylated and non-alkoxylated nonionic surfactants with bulky head groups have the following general formulas:

$$R^1—C(O)—Y'—[C(R^5)]_m—CH_2O(R_2O)_zH$$

wherein $R^1$ is selected from the group consisting of saturated or unsaturated, primary, secondary or branched chain alkyl or alkyl-aryl hydrocarbons; said hydrocarbon chain having a length of from about 6 to about 22; Y' is selected from the following groups: —O—; —N(A)—; and mixtures thereof; and A is selected from the following groups: H; $R^1$; $—(R^2—O)_z—H$; $—(CH_2)_xCH_3$; phenyl, or substituted aryl, wherein 0≦x≦about 3 and z is from about 5 to about 30; each $R^2$ is selected from the following groups or combinations of the following groups: $—CH_2)_n—$ and/or $—[CH(CH_3)CH_2]—$; and each $R_5$ is selected from the following groups: —OH; and $—O(R^2O)_z—H$ ; and m is from about 2 to about 4;

Another useful general formula for this class of surfactants is

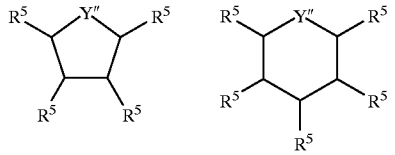

wherein Y"=N or O; and each $R^5$ is selected independently from the following: —H, —OH, $—(CH_2)xCH_3$, $—(OR^2)_z—H$, $—OR^1$, $—OC(O)R^1$, and $—CH_2(CH_2—(OR^2)_z—H)—CH_2—(OR^2)_z—C(O)R^1$, with x $R^1$, and $R^2$ as defined above in section D above and z, z', and z" are all from about 5≦to ≦about 20, more preferably the total number of z+z'+z" is from about 5 ≦ to ≦about 20. In a particularly preferred form of this structure the heterocyclic ring is a five member ring with Y"=O, one $R^5$ is —H, two $R^5$ are $—O—(R^2O)_z—H$, and at least one $R^5$ has the following structure $—CH(CH_2—(OR^2)_z—H)—CH_2—(OR^2)_z—OC(O)R^1$ with the total z+z'+z"=to from about 8≦to ≦about 20 and $R^1$ is a hydrocarbon with from about 8 to about 20 carbon atoms and no aryl group.

Another group of surfactants that can be used are polyhydroxy fatty acid amide surfactants of the formula:

$$R^6—C(O)—N(R^7)—W$$

wherein: each $R^7$ is H, $C_1$–$C_4$ hydrocarbyl, $C_1$–$C_4$ alkoxyalkyl, or hydroxyalkyl, e.g., 2-hydroxyethyl, 2-hydroxypropyl, etc., preferably $C_1$–$C_4$ alkyl, more preferably $C_1$ or $C_2$ alkyl, most preferably $C_1$ alkyl (i.e., methyl) or methoxyalkyl; and $R^6$ is a $C_5$–$C_{31}$ hydrocarbyl moiety, preferably straight chain $C_7$–$C_{19}$ alkyl or alkenyl, more preferably straight chain $C_9$–$C_{17}$ alkyl or alkenyl, most preferably straight chain $C_{11}$–$C_{17}$ alkyl or alkenyl, or mixture thereof; and W is a polyhydroxyhydrocarbyl moiety having a linear hydrocarbyl chain with at least 3 hydroxyls directly connected to the chain, or an alkoxylated derivative (preferably ethoxylated or propoxylated) thereof. W preferably will be derived from a reducing sugar in a reductive amination reaction; more preferably W is a glycityl moiety. W preferably will be selected from the group consisting of $—CH_2—(CHOH)_n—CH_2OH$, $—CH(CH_2OH)—(CHOH)_n—CH_2OH$, $—CH_2—(CHOH)_2(CHOR')(CHOH)—CH_2OH$, where n is an integer from 3 to 5, inclusive, and R' is H or a cyclic mono- or poly-saccharide, and alkoxylated derivatives thereof. Most preferred are glycityls wherein n is 4, particularly $—CH_2—(CHOH)_4—CH_2O$. Mixtures of the above W moieties are desirable.

$R^6$ can be, for example, N-methyl, N-ethyl, N-propyl, N-isopropyl, N-butyl, N-isobutyl, N-2-hydroxyethyl, N-1-methoxypropyl, or N-2-hydroxypropyl.

$R^6—CO—N<$ can be, for example, cocamide, stearamide, oleamide, lauramide, myristamide, capricamide, palmitamide, tallowamide, etc.

W can be 1-deoxyglucityl, 2-deoxyfructityl, 1-deoxymaltityl, 1-deoxylactityl, 1-deoxygalactityl, 1-deoxymannityl, 1 -deoxymaltotriotityl, etc.

(4)—Alkoxylated Cationic Quaternary Ammonium Surfactants

Alkoxylated cationic quaternary ammonium surfactants suitable for this invention are generally derived from fatty alcohols, fatty acids, fatty methyl esters, alkyl substituted phenols, alkyl substituted benzoic acids, and/or alkyl substituted benzoate esters, and/or fatty acids that are converted to amines which can optionally be further reacted with another long chain alkyl or alkyl-aryl group; this amine compound is then alkoxylated with one or two alkylene oxide chains each having ≦about 50 moles alkylene oxide moieties (e.g. ethylene oxide and/or propylene oxide) per mole of amine. Typical of this class are products obtained from the quaternization of aliphatic saturated or unsaturated, primary, secondary, or branched amines having one or two hydrocarbon chains from about 6 to about 22 carbon atoms alkoxylated with one or two alkylene oxide chains on the amine atom each having less than ≦about 50 alkylene oxide moieties. The amine hydrocarbons for use herein have from about 6 to about 22 carbon atoms, and are in either straight chain or branched chain configuration, preferably there is one alkyl hydrocarbon group in a straight chain configuration having about 8 to about 18 carbon atoms. Suitable quaternary ammonium surfactants are made with one or two alkylene oxide chains attached to the amine moiety, in average amounts of ≦about 50 moles of alkylene oxide per alkyl chain, more preferably from about 3 to about 20 moles of alkylene oxide, and most preferably from about 5 to about 12 moles of alkylene oxide per hydrophobic, e.g., alkyl group. Preferred materials of this class also have a pour points below about 70° F. (21° C.) and/or do not solidify in these softening compositions. Examples of suitable bilayer disrupters of this type include Ethoquad® 18/25, C/25, and O/25 from Akzo and Variquat® -66 (soft tallow alkyl bis(polyoxyethyl)ammonium ethyl sulfate with a total of about 16 ethoxy units) from Witco.

Preferably, the compounds of the ammonium alkoxylated cationic surfactants have the following general formula:

$$\{R^1m—Y—[(R^2—O)_z—H]_p\}^{+}\ X^-$$

wherein $R^1$ and $R^2$ are as defined previously in section D above;

Y is selected from the following groups:$=N^+—(A)_q$; $—(CH_2)_n—N^+—(A)_q$; $—B—(CH_2)_n—N^+—(A)_2$; —(phenyl)—$N^+$—$(A)_q$; —B-phenyl)—$N^+$—$(A)_q$; with n being from about 1 to about 4.

Each A is independently selected from the following groups: H; $R^1$; $—(R^2O)_z—H$; $—(CH_2)_xCH_3$; phenyl, and substituted aryl; where $0 \leqq x \leqq$ about 3; and B is selected from the following groups: —O—; —NA—; $—NA_2$; —C(O)O—; and —C(O)N(A)—; wherein $R^2$ is defined as hereinbefore; q=1 or 2; and $X^-$ is an anion which is compatible with the softening active ingredient and other components of the softening composition.

Preferred structures are those in which m=1, p=1 or 2, and about $5 \leqq z \leqq$ about 50, more preferred are structures in which m=1, p=1 or 2, and about $7 \leqq z \leqq$ about 20, and most preferred are structures in which m=1, p=1 or 2, and about $9 \leqq z \leqq$ about 12.

(5)—Alkyl Amide Alkoxylated Nonionic Surfactants

Suitable surfactants have the formula:

$$R—C(O)—N(R^4)_n—[(R^1O)_x(R^2O)_yR^3]_m$$

wherein

R is $C_{7-21}$ linear alkyl, $C_{7-21}$ branched alkyl, $C_{7-21}$ linear alkenyl, $C_{7-21}$ branched alkenyl, and mixtures thereof. Preferably R is $C_{8-18}$ linear alkyl or alkenyl.

$R^1$ is $—CH_2—CH2—$, $R_2$ is $C_3$–$C_4$ linear alkyl, $C_3$–$C_4$ branched alkyl, and mixtures thereof; preferably $R^2$ is $—CH(CH_3)—CH_2—$. Surfactants which comprise a mixture of $R^1$ and $R^2$ units preferably comprise from about 4 to about 12 $—CH_2—CH_2—$ units in combination with from about 1 to about 4 $—CH(CH_3)—CH_2—$ units. The units may be alternating or grouped together in any combination suitable to the formulator. Preferably the ratio of $R^1$ units to $R^2$ units is from about 4:1 to about 8:1. Preferably an $R^2$ unit (i.e. $—C(CH_3)H—CH_2—$) is attached to the nitrogen atom followed by the balance of the chain comprising from about 4 to 8 $—CH_2—CH_2—$ units.

$R^3$ is hydrogen, $C_1$–$C_4$ linear alkyl, $C_3$–$C_4$ branched alkyl, and mixtures thereof; preferably hydrogen or methyl, more preferably hydrogen.

$R^4$ is hydrogen, $C_1$–$C_4$ linear alkyl, $C_3$–$C_4$ branched alkyl, and mixtures thereof; preferably hydrogen. When the index m is equal to 2 the index n must be equal to 0 and the $R^4$ unit is absent.

The index m is 1 or 2, the index n is 0 or 1, provided that m+n equals 2; preferably m is equal to 1 and n is equal to 1, resulting in one $—[(R^1O)_x(R^2O)_yR^3]$ unit and $R_4$ being present on the nitrogen. The index x is from 0 to about 50, preferably from about 3 to about 25, more preferably from about 3 to about 10. The index y is from 0 to about 10, preferably 0, however when the index y is not equal to 0, y is from 1 to about 4. Preferably all the alkyleneoxy units are ethyleneoxy units.

Examples of suitable ethoxylated alkyl amide surfactants are Rewopal® $C_6$ from Witco, Amidox® C5 from Stepan, and Ethomid® O/17 and Ethomid® HT /60 from Akzo.

Minor Components of the Softening Composition

The vehicle can also comprise minor ingredients as may be known to the art. examples include: mineral acids or buffer systems for pH adjustment (may be required to maintain hydrolytic stability for certain softening active ingredients) and antifoam ingredients (e. g., a silicone emulsion as is available from Dow Corning, Corp. of Midland, Mich. as Dow Corning 2310) as a processing aid to reduce foaming when the softening composition of the present invention is used.

Stabilizers may also be used to improve the uniformity and shelf life of the dispersion. For example, an ethoxylated polyester, HOE S 4060, available from Clariant Corporation of Charlotte, N.C. may be included for this purpose.

Forming the Softening Composition

As noted above, the softening composition of the present invention is a dispersion of a softening active ingredient in a vehicle. Depending on the softening active ingredient chosen, the desired application level and other factors as may require a particular level of softening active ingredient in the composition, the level of softening active ingredient may vary between about 10% of the composition and about 50% of the composition. Preferably, the softening active ingredient comprises between about 25% and about 45% of the composition. More preferably, the softening active ingredient comprises between about 35% and about 45% of the composition. The nonionic surfactant is present at a level between about 1% and about 15% of the level of the softening active ingredient, preferably between about 2% and about 10%. Depending on the method used to produce the softening active ingredient the softening composition may also comprise between about 2% and about 30%, preferably between about 5% and about 25% of a plasticizer. As noted above, the preferred primary component of the vehicle is water. In addition, the vehicle preferably comprises an alkali or alkaline earth halide electrolyte and may comprise minor ingredients to adjust pH, to control foam, or to aid in stability of the dispersion. The following describes preparation of a particularly preferred softening composition of the present invention.

A particularly preferred softening composition of the present invention (Composition 1) is prepared as follows. The materials are more specifically defined in the table detailing Composition 1 which follows this description. Amounts used in each step are sufficient to result in the finished composition detailed in that table. The appropriate quantity of water is heated (extra added to compensate for evaporation loss) to about 165° F. (75° C.). The hydrochloric acid (25% solution) and antifoam ingredient are added. Concurrently, the blend of softening active ingredient, plasticizer, and nonionic surfactant is melted by heating it to a temperature of about 150° F. (65° C.). The melted mixture of softening active ingredient, plasticizer, and nonionic surfactant is then slowly added to the heated acidic aqueous phase with mixing to evenly distribute the disperse phase throughout the vehicle. (The water solubility of the polyethylene glycol probably carries it into the continuous phase, but this is not essential to the invention and plasticizers which are more hydrophobic and thus remain associated with the alkyl chains of the quaternary ammonium compound are also allowed within the scope of the present invention.) Once the softening active ingredient is thoroughly dispersed, part of the calcium chloride is added (as a 2.5% solution) intermittently with mixing to provide an initial viscosity reduction. The stabilizer is then slowly added to the mixture with continued agitation. Lastly, the remainder of the calcium chloride(as a 25% solution) is added with continued mixing.

Composition 1

| Component | Concentration |
|---|---|
| Continuous Phase | |
| Water | QS to 100% |
| Electrolyte[1] | 0.6% |
| Antifoam[2] | 0.2% |
| Bilayer Disrupter[3,5] | 1.0% |
| Hydrochloric Acid[4] | 0.04% |
| Plasticizer[5] | 19% |
| Stabilizer[6] | 0.5% |
| Disperse Phase | |
| Softening Active Ingredient[5] | 40.0% |

[1]0.38% from 2.5% aqueous calcium chloride solution and 0.22% from 25% aqueous calcium chloride solution
[2]Silicone Emulsion (10% active) - Dow Corning 2310 ®, marketed by Dow Corning Corp., Midland, MT
[3]Suitable nonionic surfactants are available from Shell Chemical of Houston, TX under the trade name NEODOL 91-8.
[4]Available as a 25% solution from J. T. Baker Chemical Company of Phillipsburg, NJ
[5]Bilayer disrupter, plasticizer, and softening active ingredient obtained pre-blended from Witco Chemical Company of Dublin OH (about 2 parts Neodol 91-8, about 29 parts polyethylene glycol 400, and about 69 parts tallow diester quaternary)
[6]Stabilizer is HOE S 4060, from Clariant Corp., Charlotte, NC The resulting chemical softening composition is a milky, low viscosity dispersion suitable for application to cellulosic structures as described below for providing desirable tactile softness to such structures. It displays a shear-thinning non-Newtonian viscosity. Suitably, the composition has a viscosity less than about 1000 centipoise (cp), as measured at 25° C. and at a shear rate of 100 $sec^{-1}$ using the method described in the TEST METHODS section below. Preferably, the composition has a viscosity less than about 500 cp. More preferably, the viscosity is less than about 300 cp.

The chemical composition is easily handled as a liquid and is easily shipped from the point of manufacture to point of use since it has a relatively high concentration of active ingredient. At point the of use, it is convenient to dilute the concentrate to a use concentration. This dilution step is necessary in order to allow proper metering of the softening active ingredient into the papermaking process. That is, in a commercial papermaking process, a fairly large quantity of a dispersion having a low concentration of the softener active ingredient is metered into an appropriate process stream. It will be recognized that the use concentration depends on several factors including: process capability for the metering step, the desired add-on of the softening active ingredient, the flow rates of the various process steams, and other factors as will be recognized by those having skill in the art. A suitable range of use concentrations has been found to be between about 0.5% and about 10% where the concentration is expressed as weight percent softening active ingredient. Preferably the use concentration is between about 0.5% and about 5%, more preferably between about 0.5% and about 2%. A particularly preferred use concentration is about 1%.

Optional Chemical Additives

Other materials can be added to the aqueous papermaking furnish or the embryonic web to impart other desirable characteristics to the product or improve the papermaking process so long as they are compatible with the chemistry of the softening composition and do not significantly and adversely affect the softness or strength character of the present invention. The following materials are expressly included, but their inclusion is not offered to be all-inclusive. Other materials can be included as well so long as they do not interfere or counteract the advantages of the present invention.

It is common to add a cationic charge biasing species to the papermaking process to control the zeta potential of the aqueous papermaking furnish as it is delivered to the papermaking process. These materials are used because most of the solids in nature have negative surface charges, including the surfaces of cellulosic fibers and fines and most inorganic fillers. One traditionally used cationic charge biasing species is alum. More recently in the art, charge biasing is done by use of relatively low molecular weight cationic synthetic polymers preferably having a molecular weight of no more than about 500,000 and more preferably no more than about 200,000, or even about 100,000. The charge densities of such low molecular weight cationic synthetic polymers are relatively high. These charge densities range from about 4 to about 8 equivalents of cationic nitrogen per kilogram of polymer. An exemplary material is Cypro 514®, a product of Cytec, Inc. of Stamford, Conn. The use of such materials is expressly allowed within the practice of the present invention.

The use of high surface area, high anionic charge microparticles for the purposes of improving formation, drainage, strength, and retention is taught in the art. See, for example, U. S. Pat. No. 5,221,435, issued to Smith on Jun. 22, 1993, the disclosure of which is incorporated herein by reference. Common materials for this purpose are silica colloid, or bentonite clay. The incorporation of such materials is expressly included within the scope of the present invention.

If permanent wet strength is desired, the group of chemicals: including polyamide-epichlorohydrin, polyacrylamides, styrene-butadiene lattices; insolubilized polyvinyl alcohol; urea-formaldehyde; polyethyleneimine; chitosan polymers and mixtures thereof can be added to the papermaking furnish or to the embryonic web. Preferred resins are cationic wet strength resins, such as polyamide-epichlorohydrin resins. Suitable types of such resins are described in U.S. Pat. No. 3,700,623, issued on Oct. 24, 1972, and U.S. Pat. No. 3,772,076, issued on Nov. 13, 1973, both to Keim, the disclosure of both being hereby incorporated by reference. One commercial source of useful polyamide-epichlorohydrin resins is Hercules, Inc. of Wilmington, Del., which markets such resin under the mark Kymene 557H®.

Many paper products must have limited strength when wet because of the need to dispose of them through toilets into septic or sewer systems. If wet strength is imparted to these products, fugitive wet strength, characterized by a decay of part or all of the initial strength upon standing in presence of water, is preferred. If fugitive wet strength is desired, the binder materials can be chosen from the group consisting of dialdehyde starch or other resins with aldehyde functionality such as Co-Bond 1000® offered by National Starch and Chemical Company of Scarborough, Me.; Parez 750® offered by Cytec of Stamford, Conn.; and the resin described in U.S. Pat. No. 4,981,557, issued on Jan. 1, 1991, to Bjorkquist, the disclosure of which is incorporated herein by reference, and other such resins having the decay properties described above as may be known to the art.

If enhanced absorbency is needed, surfactants may be used to treat the tissue paper webs of the present invention. The level of surfactant, if used, is preferably from about 0.01% to about 2.0% by weight, based on the dry fiber weight of the tissue web. The surfactants preferably have alkyl chains with eight or more carbon atoms. Exemplary anionic surfactants include linear alkyl sulfonates and alkylbenzene sulfonates. Exemplary nonionic surfactants include alkylglycosides including alkylglycoside esters such as Crodesta SL-40® which is available from Croda, Inc. (New York, N.Y.); alkylglycoside ethers as described in U.S. Pat. No. 4,011,389, issued to Langdon, et al. on Mar. 8, 1977; and alkylpolyethoxylated esters such as Pegosperse 200 ML available from Glyco Chemicals, Inc. (Greenwich, Conn.) and IGEPAL RC-520® available from Rhone Poulenc Corporation (Cranbury, N.J.). Alternatively, cationic softener active ingredients with a high degree of unsaturated (mono and/or poly) and/or branched chain alkyl groups can greatly enhance absorbency.

The cellulosic structures of the present invention can contain other types of chemical softeners as well. For example, another class of papermaking-added chemical softening agents comprise the well-known organo-reactive polydimethyl siloxane ingredients, including the most preferred amino functional polydimethyl siloxane.

Filler materials may also be incorporated into the tissue papers of the present invention. U.S. Pat. No. 5,611,890, issued to Vinson et al. on Mar. 18, 1997, and, incorporated herein by reference discloses filled tissue paper products that are acceptable as substrates for the present invention.

The above listings of optional chemical additives is intended to be merely exemplary in nature, and are not meant to limit the scope of the invention.

Addition Method

Furnish Preparation

Figure 2:
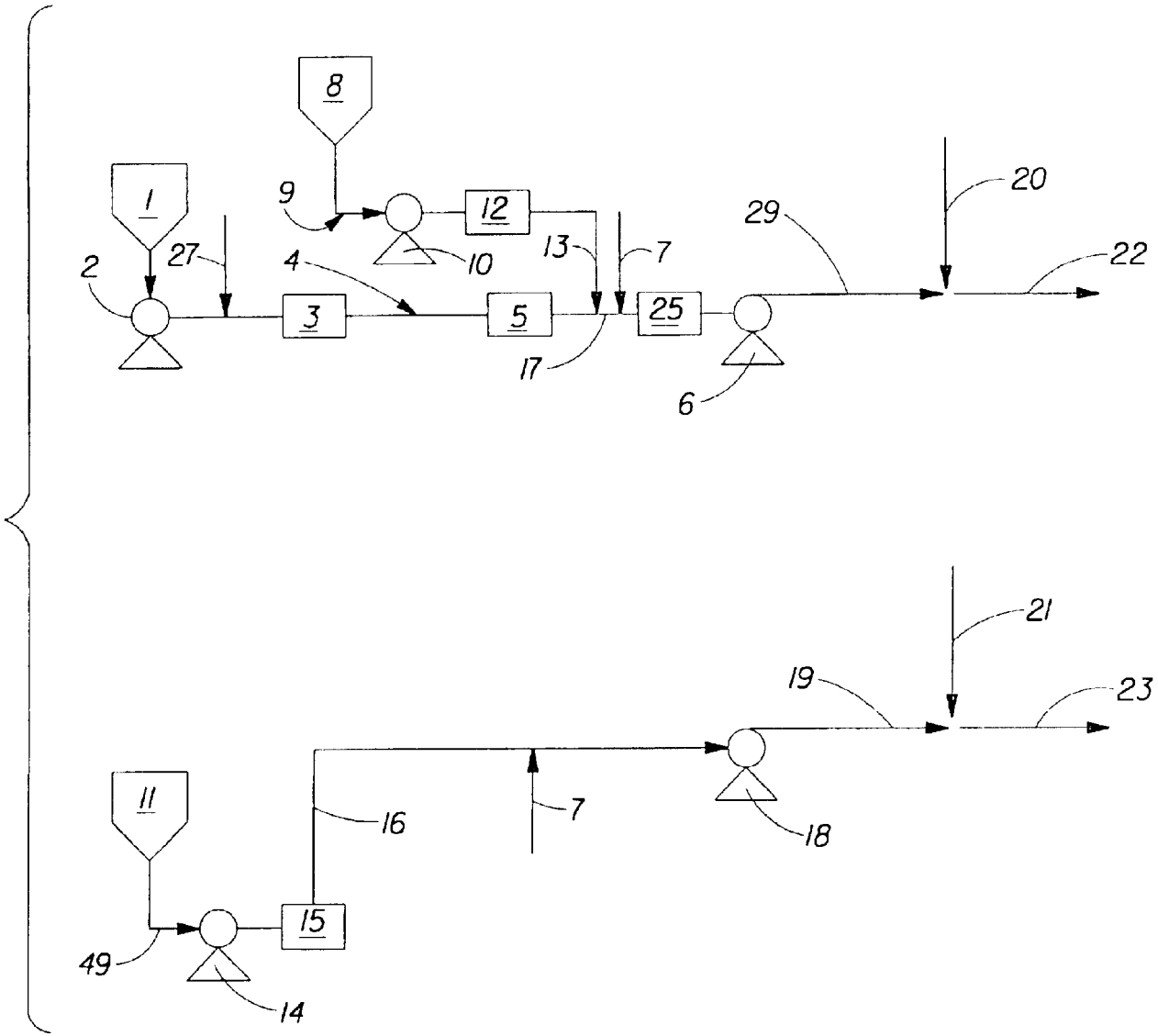
FIG. 2 is a schematic representation illustrating the steps for preparing the aqueous papermaking furnish for a creped papermaking process, according to one embodiment of the present invention.

Further insight into preparation methods for the aqueous papermaking furnish can be gained by reference to FIG. 2, which is a schematic representation illustrating a preparation of the aqueous papermaking furnish for the creped papermaking operation yielding a product according to the present invention. The following discussion refers to FIG. 2:

A storage vessel 8 is a repository for the low viscosity chemical softening composition of the present invention. Pipe 9 provides dilution water for reducing the concentration of the softening active ingredient to a suitable use concentration. Pump 10 acts to convey the diluted vesicular dispersion of the softening active ingredient. The dispersion is optionally conditioned in a mixer 12 to aid in formation of the vesicles. Resultant dispersion 13 is conveyed to a point where it is mixed with an aqueous dispersion of refined relatively long fiber papermaking fibers.

Still referring to FIG. 2, a storage vessel 1 is provided for staging an aqueous slurry of relatively long papermaking fibers. The slurry is conveyed by means of a pump 2 and optionally through a refiner 3 to fully develop the strength potential of the long papermaking fibers. Pipe 27 positioned between pump 2 and refiner 3 may be used to add a cationic debonder, if desired, to compensate for charged fines so as to minimize usage of other materials added at later stages in the process. If desired, additive pipe 4 conveys a resin to provide for wet or dry strength, in the finished product. The slurry is then further conditioned in mixer 5 to aid in absorption of the resin. After mixing with the vesicular dispersion of softening active ingredient 13, it becomes the relatively long fiber based aqueous papermaking slurry 17. Optionally, the slurry may be conditioned in mixer 25 to aid in absorption of the softening active ingredient. The suitably conditioned slurry is then diluted with white water 7 in a fan pump 6 forming a dilute long papermaking fiber slurry 29. Pipe 20 adds a cationic flocculant to the slurry 29, producing a flocculated relatively long fibered slurry 22.

Still referring to FIG. 2, a relatively short papermaking fiber slurry originates from a repository 11, from which it is conveyed through pipe 49 by pump 14 through a refiner 15 where it becomes a refined slurry of relatively short papermaking fibers 16. White water 7 is mixed with slurry 16 in a fan pump 18 at which point the slurry becomes a dilute aqueous papermaking slurry 19. Pipe 21 directs a cationic flocculant into slurry 19, after which the slurry becomes a flocculated aqueous relatively short fiber based papermaking slurry 23.

In one embodiment of a papermaking process, the flocculated relatively short-fiber based aqueous papermaking slurry 23 is directed to the creped papermaking process illustrated in FIG. 1 and is divided into two approximately equal streams which are then directed into headbox chambers 82 and 83 ultimately evolving into off-Yankee-side-layer 75 and Yankee-side-layer 71, respectively of the strong, soft creped tissue paper. Similarly, the aqueous flocculated relatively long papermaking fiber slurry 22, referring to FIG. 2, is preferably directed into headbox chamber 82*b* ultimately evolving into center layer 73 of the strong, soft creped tissue paper.

The Creped Papermaking Process

FIG. 1 is a schematic representation illustrating a creped papermaking process for producing a strong, soft creped tissue paper. These preferred embodiments are described in the following discussion, wherein reference is made to FIG. 1. FIG. 1 is a side elevational view of a preferred papermaking machine 80 for manufacturing paper according to the present invention. Referring to FIG. 1, papermaking machine 80 comprises a layered headbox 81 having a top chamber 82 a center chamber 82*b*, and a bottom chamber 83, a slice roof 84, and a Fourdrinier wire 85 which is looped over and about breast roll 86, deflector 90, vacuum suction boxes 91, couch roll 92, and a plurality of turning rolls 94. In operation, one papermaking furnish is pumped through top chamber 82 a second papermaking furnish is pumped through center chamber 82*b*, while a third furnish is pumped through bottom chamber 83 and thence out of the slice roof 84 in over and under relation onto Fourdrinier wire 85 to form thereon an embryonic web 88 comprising layers 88*a*, and 88*b*, and 88*c*. Dewatering occurs through the Fourdrinier wire 85 and is assisted by deflector 90 and vacuum boxes 91. As the Fourdrinier wire makes its return run in the direction shown by the arrow, showers 95 clean it prior to its commencing another pass over breast roll 86. At web transfer zone 93, the embryonic web 88 is transferred to a foraminous carrier fabric 96 by the action of vacuum transfer box 97. Carrier fabric 96 carries the web from the transfer zone 93 past vacuum dewatering box 98, through blow-through predryers 100 and past two turning rolls 101 after which the web is transferred to a Yankee dryer 108 by the action of pressure roll 102. The carrier fabric 96 is then cleaned and dewatered as it completes its loop by passing over and around additional turning rolls 101, showers 103, and vacuum dewatering box 105. The predried paper web is adhesively secured to the cylindrical surface of Yankee dryer 108 aided by adhesive applied by spray applicator 109. Drying is completed on the steam heated Yankee dryer 108 and by hot air which is heated and circulated through drying hood 110 by means not shown. The web is then dry creped from the Yankee dryer 108 by doctor blade 111 after which it is designated paper sheet 70 comprising a Yankee-side layer 71 a center layer 73, and an off-Yankee-side layer 75. Paper sheet 70 then passes between calendar rolls 112 and 113, about a circumferential portion of reel 115, and thence is wound into a roll 116 on a core 117 disposed on shaft 118.

Still referring to FIG. 1, the genesis of Yankee-side layer 71 of paper sheet 70 is the furnish pumped through bottom chamber 83 of headbox 81, and which furnish is applied directly to the Fourdrinier wire 85 whereupon it becomes layer 88*c* of embryonic web 88. The genesis of the center layer 73 of paper sheet 70 is the furnish delivered through chamber 82.5 of headbox 81, and which furnish forms layer 88*b* on top of layer 88*c*. The genesis of the off-Yankee-side layer 75 of paper sheet 70 is the furnish delivered through top chamber 82 of headbox 81, and which furnish forms layer 88*a* on top of layer 88*b* of embryonic web 88. Although FIG. 1 shows papermachine 80 having headbox 81 adapted to make a three-layer web, headbox 81 may alternatively be adapted to make unlayered, two layer or other multi-layer webs.

Further, with respect to making paper sheet 70 embodying the present invention on papermaking machine 80, FIG. 1, the Fourdrinier wire 85 must be of a fine mesh having relatively small spans with respect to the average lengths of the fibers constituting the short fiber furnish so that good formation will occur; and the foraminous carrier fabric 96 should have a fine mesh having relatively small opening spans with respect to the average lengths of the fibers constituting the long fiber furnish to substantially obviate bulking the fabric side of the embryonic web into the interfilamentary spaces of the fabric 96. Also, with respect to the process conditions for making exemplary paper sheet 70, the paper web is preferably dried to about 80% fiber consistency, and more preferably to about 95% fiber consistency prior to creping.

The present invention is applicable to creped tissue paper in general, including but not limited to conventionally felt-pressed creped tissue paper; high bulk pattern densified creped tissue paper; and high bulk, uncompacted creped tissue paper. One of skill in the art will also recognize that the process steps described above are exemplary and that other processes are equally within the scope of the present invention. For example, a homogeneous furnish can be provided wherein the furnish can comprise any desired blend of long and short papermaking fibers that have been treated with a vesicular dispersion of a chemical softening active ingredient using process steps similar to those described above. Processes providing tissue structures having two layers, such as that shown in Examples 3 and 4, are also within the scope of the present invention.

EXAMPLES

Example 1

This Example illustrates preparation of a preferred embodiment of the softening composition of the present invention.

Materials used in the preparation of the chemical softening mixture are:

1. Partially hydrogenated tallow diester chloride quaternary ammonium compound premixed with polyethylene glycol 400 and an ethoxylated fatty alcohol nonionic surfactant. The premix is about 69% quaternary ammonium compound (Adogen SDMC-type from Witco incorporated) 29% PEG 400 (available from J. T. Baker Company of Phillipsburg, N.J.) and 2% nonionic (available from Shell Chemical of Huston, Tex. as Neodol 91-8). The Blend is available from Witco as DXP-5429-14.
2. Calcium Chloride Pellets: from J. T. Baker Company of Phillipsburg, N.J.
3. Polydimethylsiloxane: 10% active emulsion (DC2310) from Dow Corning of Midland, Mich.
4. Hydrochloric acid (25% solution) from J. T. Baker Company of Phillipsburg, N.J.
5. Stabilizer HOE S 4060, from Clariant Corp., Charlotte, N.C.

These materials are prepared as follows to form the softening composition of the present invention.

The chemical softening composition is prepared by first heating the required quantity of water to about 75° C. The hydrochloric acid and the polydimethylsiloxane are then added to the heated water. The pH of the water premix is about 4. The premix of quaternary compound, PEG 400, and nonionic surfactant is then heated to about 65° C. and metered into the water premix with stirring until the mixture is fully homogeneous. About half of the calcium chloride is added as a 2.5% solution in water with continued stirring. The stabilizer is then added with continued mixing. Final viscosity reduction is achieved by adding the remainder of the calcium chloride (as a 25% solution) with continued mixing. The components are blended in a proportion sufficient to provide a composition having the following approximate concentrations of each of the ingredients:

| | |
|---|---|
| 40.1% | Partially hydrogenated tallow diester chloride quaternary ammonium compound |
| QS | Water |
| 17.2% | PEG 400 |
| 1.1% | Neodol 91-8 |
| 0.6% | $CaCl_2$ |
| 0.5% | Stabilizer |
| 0.02% | Polydimethylsiloxane |
| 0.02% | HCl |

After cooling and addition of make-up water, the composition has a viscosity of about 300 centipoise as measured at 25° C. and at a shear rate of 100 $sec^{-1}$ using the method described in the TEST METHODS section.

Example 2

This example illustrates the effect of nonionic surfactant chemical composition on a key softening composition property—viscosity. Chemical softening compositions are made up by first preparing a master batch containing all of the ingredients of the softening composition except a bilayer disrupter. The formula for this composition is given in Table 1.

TABLE 1

| Component | Concentration (%) |
|---|---|
| Partially hydrogenated tallow diester chloride quaternary ammonium compound | 41 |
| Water | 39 |
| PEG 400 | 19 |
| $CaCl_2$ | 0.6 |
| Stabilizer | 0.5 |
| Polydimethylsiloxane | 0.02 |
| HCl | 0.02 |

Test softening compositions are then prepared by bending potential bilayer disrupters with the master batch at levels of 1%, 2%, 3%, and 1%. Viscosity of each of the test softening compositions is measured according to the method described in the TEST METHODS section below. The viscosity of the master batch is also measured. Table 2 lists the test materials, their HLB (a measure of emulsifying effectiveness), and the viscosity for each of the composition made.

TABLE 2

| Nonionic Surfactant | HLB | Concentration (%) | Viscosity (centipoise) |
|---|---|---|---|
| Neodol 23-3[1] | 7.9 | 0 | $1.8 \times 10^{7*}$ |
| | | 1 | 6774 |
| | | 2 | 4375 |
| | | 3 | 1549 |
| | | 4 | 1365 |
| NEODOL 23-5[1] | 10.7 | 0 | 2150* |
| | | 1 | 335 |
| | | 2 | 260 |
| | | 3 | 644 |
| | | 4 | 1285 |
| NEODOL 91-8[1] | 13.9 | 0 | $1.8 \times 10^{7*}$ |
| | | 1 | 166 |
| | | 2 | 1583 |
| | | 3 | $9 \times 10^5$ |
| | | 4 | $8 \times 10^6$ |
| Surfonic N-120[2] | 14.1 | 0 | 6103* |
| | | 1 | 193 |
| | | 2 | 704 |
| | | 3 | 7595 |
| | | 4 | $9 \times 10^6$ |
| Acconon CC-6[3] | | 0 | 6103* |
| | | 1 | 450 |
| | | 2 | 421 |
| | | 3 | 1194 |
| | | 4 | $1.7 \times 10^4$ |
| Tween 60[4] | 14.9 | 0 | $6.4 \times 10^{7*}$ |
| | | 1 | 215 |
| | | 2 | 367 |
| | | 3 | 652 |
| | | 4 | 2043 |
| Plurafac B25-5[5] | 12.0 | 0 | 1029* |
| | | 1 | 442 |
| | | 2 | 2100 |
| | | 3 | $2.9 \times 10^4$ |
| | | 4 | $1.1 \times 10^7$ |

*Without being bound by theory, it is believed that the variability in viscosity is due to intermittent formation of stable liquid crystal phases due to the high concentration of softening active ingredient used. As noted above, addition of a bilayer disrupter is believed to reduce this viscosity by interrupting the structure of the liquid crystal phase.
[1]Ethoxylated fatty alcohol from Shell Chemical, Houston, TX
[2]Ethoxylated alkylphenol from Huntsman Corp., Houston, TX
[3]Ethoxylated capric/caprylic glyceride from Abitec Corp. of Columbus, OH
[4]POE(20) Sorbitan Monostearate from Henkel Corp. Charlotte, NC
[5]Modified oxyethylated straight chain alcohol from BASF Corp., Mt. Olive, NJ As can be seen, each of these materials substantially reduces the viscosity of the dispersion to less than that of the dispersion without the material.

Example 3

The purpose of this example is to illustrate a method using a conventional drying papermaking technique to make soft and absorbent tissue paper treated with a prior art chemical softener composition comprising a premix of Di(Hydrogenated)Tallow DiMethyl Ammonium Methyl Sulfate (DHTDMAMS) and a Polyoxyethylene Glycol 400 (PEG400) in solid state and a wet strength additive resin.

A pilot scale S-wrap twin-wire papermaking machine is used in the practice of the present invention. First, the substantially waterless self-emulsifiable chemical softener composition is prepared according to U.S. Pat. No. 5,474,689 wherein the homogenous premix of DHTDMAMS and PEG-400 in solid state is dispersed in a conditioned water tank (Temperature about 66° C.) to form a sub-micron vesicle dispersion.

Second, a 3% by weight aqueous slurry of Deinked Market Pulp (DMP) is made up in a conventional re-pulper. The DMP slurry is refined gently and a 0.25% solution of the wet strength resin (i.e. Kymene 557H as is available from Hercules of Wilmington, Del.) is added to the DMP stock pipe at a rate of 0.7 pounds resin/ton (0.04%) by weight of the dry fibers. The adsorption of the wet strength resin onto DMP fibers is enhanced by an in-line mixer. DHTDMAMS in the form of a chemical softener mixture according to U.S. Pat. No. 5,474,689 is also added to the DMP stock pipe (at a concentration of 1% softening active ingredient) before the stock pump, but after the wet strength resin, at a rate of about 2.5 pounds/ton (0.125%) by weight of the dry fibers. The adsorption of the chemical softener mixture to DMP fibers can be enhanced by an in-line mixer. The DMP slurry is diluted to about 0.2% consistency at the fan pump.

Third, a 3% by weight aqueous slurry of Eucalyptus fibers is made up in a conventional re-pulper. The Eucalyptus slurry is diluted to about 0.2% consistency at the fan pump.

The slurries of DMP and eucalyptus are directed into a multi-channeled headbox suitably equipped with layering leaves to maintain the streams as separate layers until discharge onto a traveling S-wrap twin-wire. A three-chambered headbox is used. The eucalyptus slurry, containing sufficient solids flow to achieve 34% of the dry weight of the ultimate paper is directed to chambers leading to the forming wire, while the DMP slurry comprising sufficient solids flow to achieve 66% of the dry weight of the ultimate paper is directed to the remaining two chambers. The DMP and eucalyptus slurries are combined at the discharge of the headbox into a composite slurry.

The composite slurry is discharged onto the traveling S-wrap twin-wire former and is dewatered. Dewatering is assisted by a deflector and vacuum boxes.

The embryonic wet web is transferred from the S-wrap twin-wire former, at a fiber consistency of about 15% at the point of transfer, to a drying fabric. A suitable drying fabric is a needle punched batt with a trilayer base fabric as is available from Albany International of Albany, N.Y. as TRIOVENT. Further dewatering is accomplished by vacuum assisted drainage until the web has a fiber consistency of about 28%.

The semi-dry web is then adhered to the surface of a Yankee dryer with a sprayed creping adhesive comprising a mixture of polyvinyl alcohol and a polyamide based resin. The creping adhesive is delivered to the Yankee surface at a rate of 0.125% adhesive solids based on the dry weight of the web.

The fiber consistency is increased to about 96% before the web is dry creped from the Yankee with a doctor blade.

The doctor blade has a bevel angle of about 20 degrees and is positioned with respect to the Yankee dryer to provide an impact angle of about 76 degrees.

The percent crepe is adjusted to about 21–25% by operating the Yankee dryer at a speed of about 1000 fpm (feet per minute) (about 305 meters per minute), while the dry web is formed into roll at a speed of about 770 fpm (235 meters per minutes).

The tissue paper has a basis weight of about 10 pounds/3000 $ft^2$ (16 grams/$m^2$), contains about 0.05% of the substantially waterless self-emulsifiable chemical softener mixture and about 0.1% of the wet strength resin. Importantly, the resulting tissue paper is soft, absorbent and is suitable for use as a facial and/or toilet tissues.

Example 4

The purpose of this example is to illustrate a method using a conventional drying papermaking technique to make soft and absorbent tissue paper treated with a low viscosity chemical softener composition prepared according to Example 1 of the present invention and a wet strength resin.

The makeup of the furnish is substantially the same as that used in Example 3, the only exception being that a 2.5% dispersion of the chemical softener mixture from Example 1 was used instead of the prior art chemical softening composition.

The separate furnishes are delivered to a headbox, deposited on a twin-wire former and dried in substantially the same manner as described in Example 3 to form a dried tissue web.

The tissue paper has a basis weight of about 10 pounds/3000 $ft^2$ (16 grams/$m^2$), contains about 0.05% of the substantially waterless self-emulsifiable chemical softener mixture and about 0.1% of the wet strength resin. Importantly, the resulting tissue paper is soft, absorbent and is suitable for use as a facial and/or toilet tissues.

Example 5

This example compares the properties of the tissue papers of Examples 3 and 4.

| Tissue Sample | Basis Weight (grams/$m^2$) | MD Tensile Strength (g/cm) | CD Tensile Strength (g/cm) | Softener Retention (%) |
|---|---|---|---|---|
| Example 3 | 16 | 62.6 | 42.5 | 17.2 |
| Example 4 | 16.5 | 75.2 | 44.8 | 16.8 |

As can be seen, the tissue papers made in Examples 3 and 4 have substantially the same physical properties.

Test Methods

Softening Active Ingredient Level on Cellulose Fibers

Analysis of the amounts of softening active ingredients described herein that are retained on cellulosic structures can be performed by any method accepted in the applicable art. These methods are exemplary, and are not meant to exclude other methods which may be useful for determining levels of particular components retained by the tissue paper.

The following method is appropriate for determining the quantity of the preferred quaternary ammonium compounds (QAC) that may be deposited by the method of the present invention. A standard anionic surfactant (sodium dodecylsulfate—NaDDS) solution is used to titrate the QAC using a dimidium bromide indicator.

Preparation of Standard Solutions

The following methods are applicable for the preparation of the standard solutions used in this titration method.

Preparation of Dimidium Bromide Indicator

To a 1 liter volumetric flask:

A) Add 500 milliliters of distilled water.

B) Add 40 ml. of dimidium bromide-disulphine blue indicator stock solution, available from Gallard-Schlesinger Industries, Inc. of Carle Place, N.Y.

C) Add 46 ml. of 5N $H_2SO_4$

D) Fill flask to the mark with distilled water and mix.

Preparation of the NaDDS solution. to a 1 liter volumetric flask.

A) Weigh 0.1154 grams of NaDDS available from Aldrich Chemical Co. of Milwaukee, Wis. as sodium dodecyl sulfate (ultra pure).

B) Fill flask to mark with distilled water and mix to form a 0.0004N solution.

Method

1. On an analytical balance, weigh approximately 0.5 grams of a specimen of the cellulosic fiber structure. Record the sample weight to the nearest 0.1 mg.
2. Place the sample in a glass cylinder having a volume of about 150 milliliters which contains a star magnetic stirrer. Using a graduated cylinder, add 20 milliliters. of methylene chloride.
3. In a fume hood, place the cylinder on a hot plate turned to low heat. Bring the solvent to a full boil while stirring and using a graduated cylinder, add 35 milliliters of dimidium bromide indicator solution.
4. While stirring at high speed, bring the methylene chloride to a full boil again. Turn off the heat, but continue to stir the sample. The QAC will complex with the indicator forming a blue colored compound in the methylene chloride layer.
5. Using a 50 ml. burette, titrate the sample with a solution of the anionic surfactant. This is done by adding an aliquot of titrant and rapidly stirring for 30 seconds. Turn off the stir plate, allow the layers to separate, and check the intensity of the blue color. If the color is dark blue add about 0.3 milliliters of titrant, rapidly stir for 30 seconds and turn off stirrer. Again check the intensity of the blue color. Repeat if necessary with another 0.3 milliliters. When the blue color starts to become very faint, add the titrant dropwise between stirrings. The endpoint is the first sign of a slight pink color in the methylene chloride layer.
6. Record the volume of titrant used to the nearest 0.05 ml.
7. Calculate the amount of QAC in the product using the equation:

$$\frac{(millilitersNaDDS - X) \times Y \times 2}{SampleWt(Grams)} = PoundsPerTonQAC$$

Where X is a blank correction obtained by titrating a specimen without the QAC of the present invention. Y is the milligrams of QAC that 1.00 milliliters of NADDS will titrate. (For example, Y=0.254 for one particularly preferred QAC, i.e. diestherdi(touch-hydrogenated)tallow dimethyl ammonium chloride.)

Density

The density of a cellulosic structure (e.g. paper), as the term "density" is used herein, is the average density calculated as the basis weight of that paper divided by the caliper, with the appropriate unit conversions incorporated therein. Caliper of the paper, as used herein, is the thickness of the paper when subjected to a compressive load of 95 g/$in^2$ (15.5 g/$cm^2$).

Strength of Tissue Papers

Dry Tensile Strength

This method is intended for use on finished paper products, reel samples, and unconverted stocks. The tensile strength of such products may be determined on one inch wide strips of sample using a Thwing-Albert Intelect II Standard Tensile Tester (Thwing-Albert Instrument Co of Philadelphia, Pa.).

Sample Conditioning and Preparation

Prior to tensile testing, the paper samples to be tested should be conditioned for at least 15 minutes at a relative humidity of 48 to 52% and within a temperature range of 22 to 24° C. Sample preparation and all aspects of the tensile testing should also take place within the confines of the constant temperature and humidity room.

For finished product, discard any damaged product. Next, remove 5 strips of four usable units (also termed sheets) and stack one on top to the other to form a long stack with the perforations between the sheets coincident. Identify sheets 1 and 3 for machine direction tensile measurements and sheets 2 and 4 for cross direction tensile measurements. Next, cut through the perforation line using a paper cutter (JDC-1-10 or JDC-1-12 with safety shield from Thwing-Albert Instrument Co. of Philadelphia, Pa.) to make 4 separate stocks. Make sure stacks 1 and 3 are still identified for machine direction testing and stacks 2 and 4 are identified for cross direction testing.

Cut two 1" wide strips in the machine direction from stacks 1 and 3. Cut two 1" wide strips in the cross direction from stacks 2 and 4. There are now four 1" wide strips for machine direction tensile testing and four 1" wide strips for cross direction tensile testing. For these finished product samples, all eight 1" wide strips are five usable units (also termed sheets) thick.

For unconverted stock and/or reel samples, cut a 15" by 15" sample which is 8 plies thick from a region of interest of the sample using a paper cutter (JDC-1-10 or JDC-1-12 with safety shield from Thwing-Albert Instrument Co of Philadelphia, Pa.). Make sure one 15" cut runs parallel to the machine direction while the other runs parallel to the cross direction. Make sure the sample is conditioned for at least 2 hours at a relative humidity of 48 to 52% and within a temperature range of 22 to 24° C. Sample preparation and all aspects of the tensile testing should also take place within the confines of the constant temperature and humidity room.

From this preconditioned 15" by 15" sample which is 8 plies thick, cut four strips 1" by 7" with the long 7" dimension running parallel to the machine direction. Note these samples as machine direction reel or unconverted stock samples. Cut an additional four strips 1" by 7" with the long 7" dimension running parallel to the cross direction. Note these samples as cross direction reel or unconverted stock samples. Make sure all previous cuts are made using a paper cutter (JDC-1-10 or JDC-1-12 with safety shield from Thwing-Albert Instrument Co. of Philadelphia, Pa.). There are now a total of eight samples: four 1" by 7" strips which are 8 plies thick with the 7" dimension running parallel to the machine direction and four 1" by 7" strips which are 8 plies thick with the 7" dimension running parallel to the cross direction.

Operation of Tensile Tester

For the actual measurement of the tensile strength, use a Thwing-Albert Intelect II Standard Tensile Tester (Thwing-Albert Instrument Co. of Philadelphia, Pa.). Insert the flat face clamps into the unit and calibrate the tester according to the instructions given in the operation manual of the Thwing-Albert Intelect II. Set the instrument crosshead speed to 4.00 in/min and the 1st and 2nd gauge lengths to 2.00 inches. The break sensitivity should be set to 20.0 grams and the sample width should be set to 1.00" and the sample thickness at 0.025".

A load cell is selected such that the predicted tensile result for the sample to be tested lies between 25% and 75% of the range in use. For example, a 5000 gram load cell may be used for samples with a predicted tensile range of 1250 grams (25% of 5000 grams) and 3750 grams (75% of 5000 grams). The tensile tester can also be set up in the 10% range with the 5000 gram load cell such that samples with predicted tensiles of 125 grams to 375 grams could be tested.

Take one of the tensile strips and place one end of it in one clamp of the tensile tester. Place the other end of the paper strip in the other clamp. Make sure the long dimension of the strip is running parallel to the sides of the tensile tester. Also make sure the strips are not overhanging to the either side of the two clamps. In addition, the pressure of each of the clamps must be in full contact with the paper sample.

After inserting the paper test strip into the two clamps, the instrument tension can be monitored. If it shows a value of 5 grams or more, the sample is too taut. Conversely, if a period of 2–3 seconds passes after starting the test before any value is recorded, the tensile strip is too slack.

Start the tensile tester as described in the tensile tester instrument manual. The test is complete after the crosshead automatically returns to its initial starting position. Read and record the tensile load in units of grams from the instrument scale or the digital panel meter to the nearest unit.

If the reset condition is not performed automatically by the instrument, perform the necessary adjustment to set the instrument clamps to their initial starting positions. Insert the next paper strip into the two clamps as described above and obtain a tensile reading in units of grams. Obtain tensile readings from all the paper test strips. It should be noted that readings should be rejected if the strip slips or breaks in or at the edge of the clamps while performing the test.

Calculations

For the four machine direction 1" wide finished product strips, sum the four individual recorded tensile readings. Divide this sum by the number of strips tested. This number should normally be four. Also divide the sum of recorded tensiles by the number of usable units per tensile strip. This is normally five for both 1-ply and 2-ply products.

Repeat this calculation for the cross direction finished product strips.

For the unconverted stock or reel samples cut in the machine direction, sum the four individual recorded tensile readings. Divide this sum by the number of strips tested. This number should normally be four. Also divide the sum of recorded tensiles by the number of usable units per tensile strip. This is normally eight.

Repeat this calculation for the cross direction unconverted or reel sample paper strips.

All results are in units of grams/inch.

For purposes of this specification, the tensile strength should be converted into a "specific total tensile strength" defined as the sum of the tensile strength measured in the machine and cross machine directions, divided by the basis weight, and corrected in units to a value in meters.

Viscosity

Overview

Viscosity is measured at a shear rate of 100 ($s^{-1}$) using a rotational viscometer. The samples are subjected to a linear stress sweep, which applies a range of stresses, each at a constant amplitude.

| Apparatus | |
|---|---|
| Viscometer | Dynamic Stress Rheometer Model SR500 which is available from Rheometrics Scientific, Inc. of Piscataway, NJ |

-continued

| | |
|---|---|
| Sample Plates Setup | 25 mm parallel insulated plates are used |
| Gap | 0.5 mm |
| Sample Temperature | 20° C. |
| Sample Volume | at least 0.2455 $cm^3$ |
| Initial Shear Stress | 10 dynes/$cm^2$ |
| Final Shear Stress | 1,000 dynes/$cm^2$ |
| Stress Increment | 25 dynes/$cm^2$ applied every 20 seconds |

Method

Place the sample on the sample plate with the gap open. Close the gap and operate the rheometer according to the manufacturer's instructions to measure viscosity as a function of shear stress between the initial shear stress and the final shear stress using the stress increment defined above.

Results and Calculation

The resulting graphs plot log shear rate ($s^{-1}$) on the x-axis, log viscosity, Poise (P) on the left y-axis, and stress (dynes/$cm^2$) on the right y-axis. Viscosity values are read at a shear rate of 100 ($s^{-1}$). The values for viscosity are converted from P to centipoise (cP) by multiplying by 100.

The disclosures of all patents, patent applications (and any patents which issue thereon, as well as any corresponding published foreign patent applications), and publications mentioned throughout this description are hereby incorporated by reference herein. It is expressly not admitted, however, that any of the documents incorporated by reference herein teach or disclose the present invention.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A method of producing a soft tissue paper product, the method comprising the steps of:

a) providing a chemical softening composition, said chemical softening composition comprising:
   a vehicle;
   a softening active ingredient, wherein said softening active ingredient comprises a quaternary ammonium compound;
   an electrolyte; and
   a bilayer disrupter;

b) diluting said chemical softening composition to a use concentration;

c) providing a slurry of papermaking fibers;

d) treating said slurry of papermaking fibers with said diluted chemical softening composition;

e) depositing said treated slurry of said papermaking fibers on a foraminous forming wire; and f) dewatering said treated slurry by drainage through said foraminous forming wire to form an embryonic web.

2. The method of claim 1 wherein said method comprises the additional steps of after step f:

a) transferring said embryonic web to a carrier fabric; and b) drying said dewatered slurry while said slurry is supported by said carrier fabric to form a predried paper web.

3. The method of claim 2 wherein said method comprises the additional steps of after step b:

a) transferring said predried paper web to a drying cylinder; and b) drying said predried web to form a paper sheet.

4. The method of claim 1 wherein:

a) said slurry of papermaking fibers comprises separate slurries, a first slurry of relatively short papermaking fibers and a second slurry of relatively long papermaking fibers;

b) only said second slurry is treated with said diluted chemical softening composition; and c) said first slurry is disposed on said Foraminous fabric between said wire and said second slurry.

5. The method of claim 1 wherein said softening active ingredient comprises at least about 25% of said composition.

6. The method of claim 4 wherein said softening active ingredient comprises at least about 35% of said composition.

7. The method of claim 1 wherein said softening active ingredient comprises a quaternary ammonium compound.

8. The method of claim 7 wherein said quaternary ammonium compound has the formula:

$$(R_1)_{4-m}—N^+—[(CH_2)_n—Y—R_3]_mX^-$$

wherein

Y is —O—(O)C—, or —C(O)—O—, or —NH—C(O)—, or —C(O)—NH—;

m is 1 to 3;

n is 0 to 4;

each $R_1$ is a $C_1$–$C_6$ alkyl or alkenyl group, hydroxyalkyl group, hydrocarbyl or substituted hydrocarbyl group, alkoxylated group, benzyl group, or mixtures thereof;

each $R_3$ is a $C_{13}$–$C_{21}$ alkyl or alkenyl group, hydroxyalkyl group, hydrocarbyl or substituted hydrocarbyl group, alkoxylated group, benzyl group, or mixtures thereof; and $X^-$ is any softener-compatible anion.

9. The method of claim 8 wherein m is 2, n is 2, $R_1$ is methyl, $R_3$ is $C_{15}$–$C_{17}$ alkyl or alkenyl, and Y is —O—(O)C—, or —C(O)—O—.

10. The method of claim 9 wherein $X^-$ is chloride or methyl sulfate.

11. The method of claim 7 wherein said composition further comprises a plasticizer.

12. The method of claim 11 wherein said plasticizer is selected from the group consisting of polyethylene glycol, polypropylene glycol and mixtures thereof.

13. The method of claim 2 wherein said vehicle is water and said electrolyte is a salt selected from the group consisting of the chloride salts of sodium, calcium, and magnesium.

14. The method of claim 13 wherein said salt is present at a level between about 0.1% and about 20% by weight of said composition.

15. The method of claim 1 wherein said bilayer disrupter is used at a level of between about 2% and about 15% of the level of said softening active ingredient.

16. The method of claim 1 wherein said bilayer disrupter is selected from the group consisting of:

1. nonionic surfactants derived from saturated and/or unsaturated primary, secondary, and/or branched, amine, amide, amine-oxide fatty alcohol, fatty acid, alkyl phenol, and/or alkyl aryl carboxylic acid compounds having from about 6 to about 22 carbon atoms in a hydrophobic chain, wherein at least one active hydrogen of said compounds is ethoxylated with ≦50 ethylene oxide moieties to provide an HLB of from about 6 to about 20;

2. nonionic surfactants with bulky head groups selected from:

a. surfactants having the formulas:

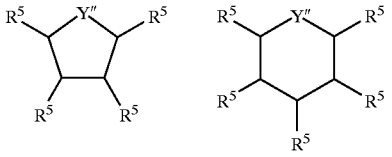

wherein Y"=N or O; and each $R^5$ is selected independently from the following:

—H, —OH, —$(CH_2)xCH_3$, —$O(OR^2)_z$—H, —$OR^1$, —$OC(O)R^1$, and —$CH(CH_2$—$(OR^2)_{z''}$—H)—$CH_2$—$(OR^2)_{z'}$—$C(O)R^1$, x and $R^1$ are as defined above and 5≦z, z', and z"≦20; and b. polyhydroxy fatty acid amide surfactants of the formula:

$R^2$—C(O)—N($R^1$)—Z wherein: each $R^1$ is H, $C_1$–$C_4$ hydrocarbyl, $C_1$–$C_4$ alkoxyalkyl, or hydroxyalkyl; $R^2$ is a $C_5$–$C_{21}$ hydrocarbyl moiety; and each Z is a polyhydroxyhydrocarbyl moiety having a linear hydrocarbyl chain with at least 3 hydroxyls directly connected to the chain, or an ethoxylated derivative thereof; and 3. cationic surfactants having the formula:

$\{R^1m$—Y—$[(R^2$—$O)_z$—$H]_p\}^+X^-$ wherein $R^1$ is selected from the group consisting of saturated or unsaturated, primary, secondary or branched chain alkyl or alkyl-aryl hydrocarbons; said hydrocarbon chain having from about 6 to about 22 carbon atoms; each $R^2$ is selected from the following groups or combinations of the following groups: —$(CH_2)_n$— and/or —$[CH(CH_3)CH_2]$—; Y is selected from the following groups:=$N^+$—$(A)_q$; —$(CH_2)_n$—$N^+$—$(A)_q$; —B—$(CH_2)_n$—$N^+$—$(A)_2$; -(phenyl)-$N^+$—$(A)_q$; -(B-phenyl)=$N^+$—$(A)_q$; with n being from about 1 to about 4, wherein each A is independently selected from the following groups: H; $C_{1-5}$ alkyl; $R^1$; —$(R^2O)_z$—H; —$(CH_2)_xCH_3$; phenyl, and substituted aryl; where 0≦x≦about 3; and each B is selected from the following groups: —O—; —NA—; —$NA_2$; —C(O)O—; and —C(O)N(A)—; wherein $R^2$ is defined as hereinbefore; q=1 or 2; total z per molecule is from about 3 to about 50; and $X^-$ is an anion which is compatible with fabric softener actives and adjunct ingredients.

17. The method of claim 16 wherein said bilayer disrupter is a nonionic surfactant having a hydrophobic moiety that is selected from the group consisting of: fatty alcohols having between about 8 and about 18 carbon atoms and alkyl phenols having between about 8 and about 18 carbon atoms wherein said hydrophobic moiety is ethoxylated with between about 3 and about 15 ethylene oxide moieties.

18. The method of claim 1 wherein said use concentration is between about 0.5% and about 10%.

19. The method of claim 18 wherein said use concentration is between about 0.5% and about 5%.

20. The method of claim 19 wherein said use concentration is about 1%.

* * * * *